US010174940B2

(12) United States Patent
Yamamoto et al.

(10) Patent No.: US 10,174,940 B2
(45) Date of Patent: Jan. 8, 2019

(54) RAW MATERIAL POWDER-HEATING METHOD

(71) Applicant: TAIYO NIPPON SANSO CORPORATION, Tokyo (JP)

(72) Inventors: Yasuyuki Yamamoto, Hokuto (JP); Takayuki Fujimoto, Kofu (JP); Yoshiyuki Hagihara, Kofu (JP); Kimio Iino, Kai (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 0 days.

(21) Appl. No.: 15/488,729

(22) Filed: Apr. 17, 2017

(65) Prior Publication Data

US 2017/0219204 A1 Aug. 3, 2017

Related U.S. Application Data

(62) Division of application No. 14/773,879, filed as application No. PCT/JP2014/057514 on Mar. 19, 2014, now Pat. No. 9,671,107.

(30) Foreign Application Priority Data

Mar. 21, 2013 (JP) ..... 2013-059023

(51) Int. Cl.
*F23D 1/00* (2006.01)
*F23D 17/00* (2006.01)
(Continued)

(52) U.S. Cl.
CPC ..... *F23D 1/00* (2013.01); *F23D 14/20* (2013.01); *F23D 14/22* (2013.01); *F23D 14/58* (2013.01); *F23D 17/00* (2013.01)

(58) Field of Classification Search
CPC . F24D 1/00; F23D 14/22; F23D 14/58; F23D 17/00
(Continued)

(56) References Cited

U.S. PATENT DOCUMENTS 2,832,401 A * 4/1958 Lail ..... F23D 91/02 122/6.5
4,373,900 A 2/1983 Eckelmann
(Continued)

FOREIGN PATENT DOCUMENTS

CN 1781593 6/2006
CN 101065613 10/2007
(Continued)

OTHER PUBLICATIONS

JP2010106132 A, by Akiyama et al, Solid-Fuel gasification burner, May 2010, English M/c translation.*
(Continued)

*Primary Examiner* — Gregory Huson
*Assistant Examiner* — Nikhil Mashruwala
(74) *Attorney, Agent, or Firm* — Nixon & Vanderhye P.C.

(57) ABSTRACT

An object of the present invention is to provide a combustion burner that is capable of efficiently performing heating of a raw material powder by improving the dispersibility of the raw material powder that is ejected from a raw material powder-ejecting port using a simple configuration, and a combustion burner in which raw material powder introduction pipes that introduce the raw material powder inside a raw material powder supply pathway are provided so that axes that extend from central axes of the raw material powder introduction pipes do not intersect a central axis of the burner main body, and so that angles θ that are formed by central axes of the raw material powder introduction
(Continued)

pipes and an outer surface of a second circular member are larger than 0° and smaller than 90°.

2 Claims, 10 Drawing Sheets

(51) Int. Cl.
*F23D 14/22* (2006.01)
*F23D 14/58* (2006.01)
*F23D 14/20* (2006.01)

(58) Field of Classification Search
USPC ..... 431/2, 8, 188, 174; 110/261, 28
See application file for complete search history.

(56) References Cited

U.S. PATENT DOCUMENTS

| | | | | |
|---|---|---|---|---|
| 4,428,727 | A | 1/1984 | Deussner et al. | |
| 4,679,512 | A | 7/1987 | Skoog | |
| 5,178,533 | A | 1/1993 | Collenbusch | |
| 5,513,583 | A | 5/1996 | Battista | |
| 6,116,171 | A | 9/2000 | Oota et al. | |
| 6,315,551 | B1 | 11/2001 | Salzsieder et al. | |
| 9,285,113 | B2 * | 3/2016 | Kang | F23C 9/006 |
| 9,447,969 | B2 | 9/2016 | Recourt et al. | |
| 9,709,269 | B2 * | 7/2017 | D'Agostini | F23L 7/007 |
| 10,066,832 | B2 * | 9/2018 | Disselhorst | C10J 3/506 |
| 2006/0112784 | A1 | 6/2006 | Sakaguchi et al. | |
| 2006/0275723 | A1 | 12/2006 | Che | |
| 2010/0003625 | A1 | 1/2010 | Ohlsen et al. | |
| 2011/0146450 | A1 * | 6/2011 | Docquier | F23D 14/22 75/414 |
| 2012/0247376 | A1 | 10/2012 | Matsumoto et al. | |
| 2013/0291769 | A1 * | 11/2013 | Debashis | F23K 3/02 110/106 |

FOREIGN PATENT DOCUMENTS

| | | | | |
|---|---|---|---|---|
| CN | 101675301 | | 3/2010 | |
| EP | 0 570 084 | | 11/1993 | |
| JP | 59-193558 | | 12/1984 | |
| JP | 1-312384 | | 12/1989 | |
| JP | 3-69527 | | 3/1991 | |
| JP | 5-17164 | | 1/1993 | |
| JP | 8-240303 | | 9/1996 | |
| JP | 2004-536008 | | 12/2004 | |
| JP | 3688944 | | 8/2005 | |
| JP | 2006-76826 | | 3/2006 | |
| JP | 2008-39362 | | 2/2008 | |
| JP | 2009-92254 | | 4/2009 | |
| JP | 2009-198083 | | 9/2009 | |
| JP | 2010-37134 | | 2/2010 | |
| JP | 2010-106132 | | 5/2010 | |
| JP | 2010-196117 | | 9/2010 | |
| JP | 2012-96942 | | 5/2012 | |
| JP | 2012-189311 | | 10/2012 | |
| JP | 2012-207817 | | 10/2012 | |
| JP | 2012-250886 | | 12/2012 | |
| TW | 200835888 | | 9/2008 | |
| TW | 200930952 | | 7/2009 | |
| WO | WO 02/098805 | | 12/2002 | |
| WO | WO2012032382 | A2 * | 3/2012 | F23K 3/02 |

OTHER PUBLICATIONS

JP2012250886 A, by Tanaka et al, Manufacture of Molten glass, Dec. 2012, English M/c translation.*
Chinese Office Action issued in Application No. 201480003610.5 dated Apr. 18, 2016 (w/ partial translation).
International Search Report issued in PCT/JP2014/057514 dated Jun. 17, 2014.
Taiwanese Office Action issued in Appln. No. 103110063 dated Apr. 10, 2018 (w/ partial translation).

* cited by examiner

RAW MATERIAL POWDER-HEATING METHOD

This application is a divisional of U.S. application Ser. No. 14/773,879, filed Sep. 9, 2015, which is the U.S. national phase of International Application No. PCT/JP2014/057514 filed Mar. 19, 2014 which designated the U.S. and claims priority to JP Patent Application No. 2013-059023 filed Mar. 21, 2013, the entire contents of each of which are hereby incorporated by reference.

TECHNICAL FIELD

The present invention relates to a combustion burner which heats a powder (a raw material powder), a burner apparatus, and a raw material powder-heating method.

BACKGROUND ART

Combustion burners are used in the metal melting of iron and the like, in the manufacture of glass, in the incineration of waste, and the like. As methods that heat a target object such as metal, glass, waste, or the like, using a combustion burner, there are methods that heat by directly applying a flame to a target object, and there are methods that heat a target object indirectly using radiant heat of flame.

In comparison with methods that heat a target object indirectly using radiant heat of flame, methods that heat by directly applying flame to a target object have an advantage in that the efficiency of utilization of energy is high.

Patent Document No. 1 discloses melting a cold iron source using a combustion burner that heats by directly applying flame to the target object.

Given that, in a case in which a target object to be heated is a powder (a raw material powder), since the surface area per volume of the target object is large, it is possible to heat the target object with high efficiency by passing the target object through the flame and/or a high temperature region in the vicinity of the flame (hereinafter, referred to as a "flame region").

Patent Document Nos. 2 to 4 disclose combustion burners and burning methods that heat by installing a powder-ejecting port, from which powder is ejected, in a combustion burner or in the vicinity of a combustion burner; and directly injecting the powder into the flame region while simultaneously ejecting the powder.

In the combustion burners that are disclosed in Patent Document Nos. 2 to 5, the powder-ejecting port is disposed in the center of the combustion burner, or in the vicinity thereof (hereinafter, referred to as "a central part of the combustion burner").

However, powder has a property in which dispersal is difficult since there is no Brownian motion, and therefore, there is a tendency for uneven distribution.

In a case in which powder, which passes through a flame region of a combustion burner, is unevenly distributed, a situation in which the powder is not sufficiently heated in portions in which the density of the powder is high, and conversely, in which the heat of the flame is not utilized sufficiently in portions in which the density of the powder is low, arises. Therefore, the efficiency of utilization of the energy of the combustion burners is reduced.

In such an instance, in a case in which powder is heated using a combustion burner, it is necessary to disperse the powder and pass the powder through a flame region.

However, in the combustion burners that are disclosed in Patent Document Nos. 2 to 4, since the ejecting ports of powder are disposed in the central part of the combustion burner, the powder is passed through the flame region in an unevenly distributed state. Therefore, it is difficult to heat the powder, and the methods are inefficient.

As a related art technique that is capable of solving this problem, there are multiple pipe structure combustion burners that are set to have configurations in which, rather than being disposed in a central part of the combustion burner, a plurality of powder-ejecting ports are disposed at a periphery, which is a position that is further on an outer side than the central part of the combustion burner and has the center of the combustion burner as the center thereof, and in which the periphery, on which the plurality of powder-ejecting ports are disposed, is interposed between a periphery on which a plurality of burnable gas ejecting ports, which eject burnable vapor, and a periphery on which a plurality of fuel gas ejecting ports, which eject fuel, are disposed (for example, refer to Patent Document Nos. 5 and 6).

By using the abovementioned multiple pipe structure combustion burners, since powder is spread out and ejected, it is possible to greatly improve the dispersibility of powder that passes through a flame region.

RELATED ART DOCUMENT

Patent Document

[Patent Document No. 1] Japanese Unexamined Patent Application, First Publication No. 2008-39362

[Patent Document No. 2] Japanese Unexamined Patent Application, First Publication No. 2010-37134

[Patent Document No. 3] Japanese Unexamined Patent Application, First Publication No. 2010-196117

[Patent Document No. 4] Japanese Unexamined Patent Application, First Publication No. 2009-92254

[Patent Document No. 5] Japanese Patent No. 3688944

[Patent Document No. 6] Japanese Unexamined Patent Application, First Publication No. 2009-198083

SUMMARY OF INVENTION

Technical Problem to be Solved

However, even if the multiple pipe structure combustion burners disclosed in Patent Document Nos. 5 and 6 are used, powder is not uniformly dispersed and ejected in each region of the powder-ejecting ports, and therefore, a striated flow, in which powder is unevenly distributed, is sometimes ejected from the powder-ejecting ports.

In this case, even if the powder-ejecting ports are disposed at a periphery, it is not possible to sufficiently heat the powder. Therefore, even in a case in which a multiple pipe structure combustion burner in which powder-ejecting ports are disposed at a periphery is used, in order to exhibit the effects of such a combustion burner, it is necessary to eject the powder in a uniformly dispersed state at the periphery.

Meanwhile, as methods that are capable of improving powder dispersibility, there are methods that utilize a vapor flow. More specifically, for example, there are methods that disperse powder by transporting the powder in a vapor flow and ejecting the powder at high speed, and methods that create a mixed vapor flow in which vapor and powder are mixed uniformly.

However, in methods that utilize a vapor flow, it is necessary to set a supply amount (a flow amount) of a vapor that is used in the dispersal and transport of the powder to be high. Therefore, in a flame region, apart from the heating of the powder, since a large amount of energy is expended in the heating of the vapor, the heating efficiency of the powder is poor.

In addition, an ejecting rate of powder that is ejected from the powder-ejecting ports increases as a result of the increase in the supply amount of vapor for transport. As a result of this, the heating efficiency of the powder is immediately reduced since a retention time of powder in a flame region is shorter.

Due to the abovementioned reasons, in a case in which powder is heated, it can be said that a method that disperses powder by increasing a supply amount of vapor is an inefficient method.

In addition, ejecting powder at high speed using a vapor flow leads to the dissipation of powder, and therefore, also causes a problem of a deterioration in yield.

Furthermore, since it is necessary to apply high pressure to a vapor flow, it is necessary to make midway piping, equipment and the combustion burner long and large. Therefore, there is a concern that the piping will become blocked.

For these reasons, a method that disperses powder using large amounts of vapor for transport is unrealistic.

In addition, even if the dispersibility of a powder is increased before supplying to a combustion burner, there is a concern that the powder will become unevenly distributed again inside piping that leads to the combustion burner or during introduction into the combustion burner. In this case, it is not possible to eject the powder in a dispersed state from the powder-ejecting port.

Nevertheless, the combustion burner having a long and large organization or a complex and fine structure is unrealistic since there is a large deterioration in economic efficiency and operability, and this can cause the combustion burner to become blocked with the powder.

In such an instance, an object of the present invention is to provide a combustion burner, a burner apparatus and a raw material powder-heating method that are capable of efficiently performing heating of a raw material powder by improving the dispersibility of the raw material powder that is ejected from a raw material powder-ejecting port using a simple configuration.

Means for Solving the Problem

The abovementioned object is achieved by (1) to (12) below.

(1) A combustion burner including at least a burner main body that forms a flame, and two or more raw material powder introduction pipes, in which the burner main body has a plurality of pathways, which include a raw material powder supply pathway that supplies raw material powder and one or more pathways that are provided on an inner side of the raw material powder supply pathway, and which are formed by a plurality of circular members, which are disposed concentrically; and a raw material powder-ejecting port that ejects the raw material powder that is supplied by the raw material powder supply pathway, and a plurality of ejecting ports that are positioned on an inner side of the raw material powder-ejecting port, the raw material powder supply pathway is formed by a first raw material powder supply pathway-partitioning circular member that partitions an outer side of the pathway, and a second raw material powder supply pathway-partitioning circular member that partitions an inner side of the pathway, and the two or more raw material powder introduction pipes are provided in the first raw material powder supply pathway-partitioning circular member, are provided so that axes that extend from central axes of the raw material powder introduction pipes do not intersect a central axis of the burner main body, and so that angles that are formed by central axes of the raw material powder introduction pipes and an outer surface of the second raw material powder supply pathway-partitioning circular member are larger than 0° and smaller than 90°, and are disposed so as to be rotationally symmetrical to a central axis of the burner main body.

(2) The combustion burner according to (1), in which the angles that are formed by central axes of the raw material powder introduction pipes and an outer surface of the second raw material powder supply pathway-partitioning circular member are 10° or more and less than 45°.

(3) The combustion burner according to (1) or (2), in which a relationship between internal diameters d of the raw material powder introduction pipes, and an external diameter $\phi$ of the second raw material powder supply pathway-partitioning circular member satisfies Expression (1) below.

$$\phi > 2d \quad (1)$$

(4) The combustion burner according to any one of (1) to (3), in which, among the plurality of ejecting ports, a form of ejecting ports other than ejecting ports that are disposed on an innermost side is ring shaped.

(5) The combustion burner according to any one of (1) to (4), further including a raw material powder introduction port, which are provided in the raw material powder introduction pipes, and through which the raw material powder is injected into the raw material powder introduction pipes.

(6) The combustion burner according to (5), in which an even number of the raw material powder introduction ports is disposed in a single raw material powder introduction pipe.

(7) The combustion burner according to any one of (1) to (6), in which the plurality of pathways include a burnable fluid supply pathway that supplies a burnable fluid, and a fuel fluid supply pathway that supplies a fuel fluid.

(8) The combustion burner according to (7), in which the raw material powder supply pathway is disposed between the burnable fluid supply pathway and the fuel fluid supply pathway.

(9) A burner apparatus including the combustion burner according to any one of (6) to (8), and a raw material powder distributor that includes a raw material powder introduction unit that is formed in a cylindrical shape, a plurality of raw material powder lead-out units that lead the raw material powder out to the raw material powder introduction ports, and a raw material powder distribution unit, which is disposed between the raw material powder introduction unit and the plurality of raw material powder lead-out units, is formed in a wide profile from the raw material powder introduction unit toward the plurality of raw material powder lead-out units, and includes a space which distributes the raw material powder to the plurality of raw material powder lead-out units, in which the plurality of raw material powder lead-out units are disposed so as to be point-symmetrical to a center of the raw material powder introduction unit, and the even number of raw material powder introduction ports which are disposed in the same raw material powder introduction pipe are connected to a raw material powder lead-out units that are disposed in point symmetry thereto.

(10) The burner apparatus according to (9), in which the plurality of raw material powder lead-out units are disposed so as to be spread out on an outer side from a connection position with the raw material powder distribution unit.

(11) A raw material powder-heating method that heats raw material powder with a flame that is formed at a leading end of a burner main body that configures a burner apparatus using a burnable fluid and a fuel fluid, the method including a raw material powder introduction step of introducing the raw material powder into a raw material powder supply pathway, which is formed in a tubular shape, in a direction that is inclined at an angle of larger than 0° and smaller than 90° with respect to the raw material powder supply pathway, and from a direction that does not intersect a central axis of the burner main body, and a heating step of heating the raw material powder with the a flame while ejecting the raw material powder that is supplied by the raw material powder supply pathway from powder-ejecting ports.

(12) The raw material powder-heating method according to (11), further including a step of distributing a plurality of the raw material powder using a raw material powder distributor before the raw material powder introduction step, in which raw material powder that is distributed by the raw material powder distributor is introduced into the raw material powder supply pathway in the raw material powder introduction step.

Advantageous Effects of Invention

According to the combustion burner of the present invention, by providing two or more raw material powder introduction pipes, through which raw material powder is introduced to the raw material powder supply pathway, in the first raw material powder supply pathway-partitioning circular member that partitions an outer side of the raw material powder supply pathway, and disposing the raw material powder introduction pipes so as to be inclined so that angles that are formed by central axes of the raw material powder introduction pipes and an outer surface of the second raw material powder supply pathway-partitioning circular member are angles that are larger than 0° and smaller than 90°, it is possible to disperse the raw material powder inside the raw material powder supply pathway in a circumferential direction (a horizontal direction) of the raw material powder supply pathway by causing the raw material powder to collide with external walls of the second raw material powder supply pathway-partitioning circular member.

Furthermore, since it is possible to cause the raw material powder to collide with the external walls of the second raw material powder supply pathway-partitioning circular member by disposing the two or more raw material powder introduction pipes so that axes that extend from central axes of the raw material powder introduction pipes do not intersect a central axis of the burner main body, and so as to be rotationally symmetrical to a burner central axis, it is possible to make dispersal of the raw material powder inside the raw material powder supply pathway uniform in a circumferential direction of the raw material powder supply pathway.

As a result of this, since it is possible to eject the dispersed raw material powder from the raw material powder-ejecting port, it is possible to efficiently heat the raw material powder using a flame and/or a high temperature region in the vicinity of the flame (hereinafter, referred to as a "flame region").

In addition, since it is not necessary to use a particularly high-speed vapor flow (a vapor for raw material powder transport) in the dispersal of the raw material powder, the configuration of the combustion burner is not complicated, and therefore, it is difficult for the combustion burner to become blocked.

Accordingly, according to the combustion burner of the present invention, it is possible to efficiently perform heating of a raw material powder by improving the dispersibility of the raw material powder that is ejected from a raw material powder-ejecting port using a simple configuration.

DESCRIPTION OF EMBODIMENTS

Embodiments in which the present invention has been applied will be described in detail below with reference to the drawings. Additionally, the drawings that are used in the following description are for describing configurations of embodiments of the present invention, and there are cases in which the size, thickness, dimensions and the like of each part that is illustrated have been altered from a practical dimensional relationship of a burner apparatus.

First Embodiment

Figure 1:
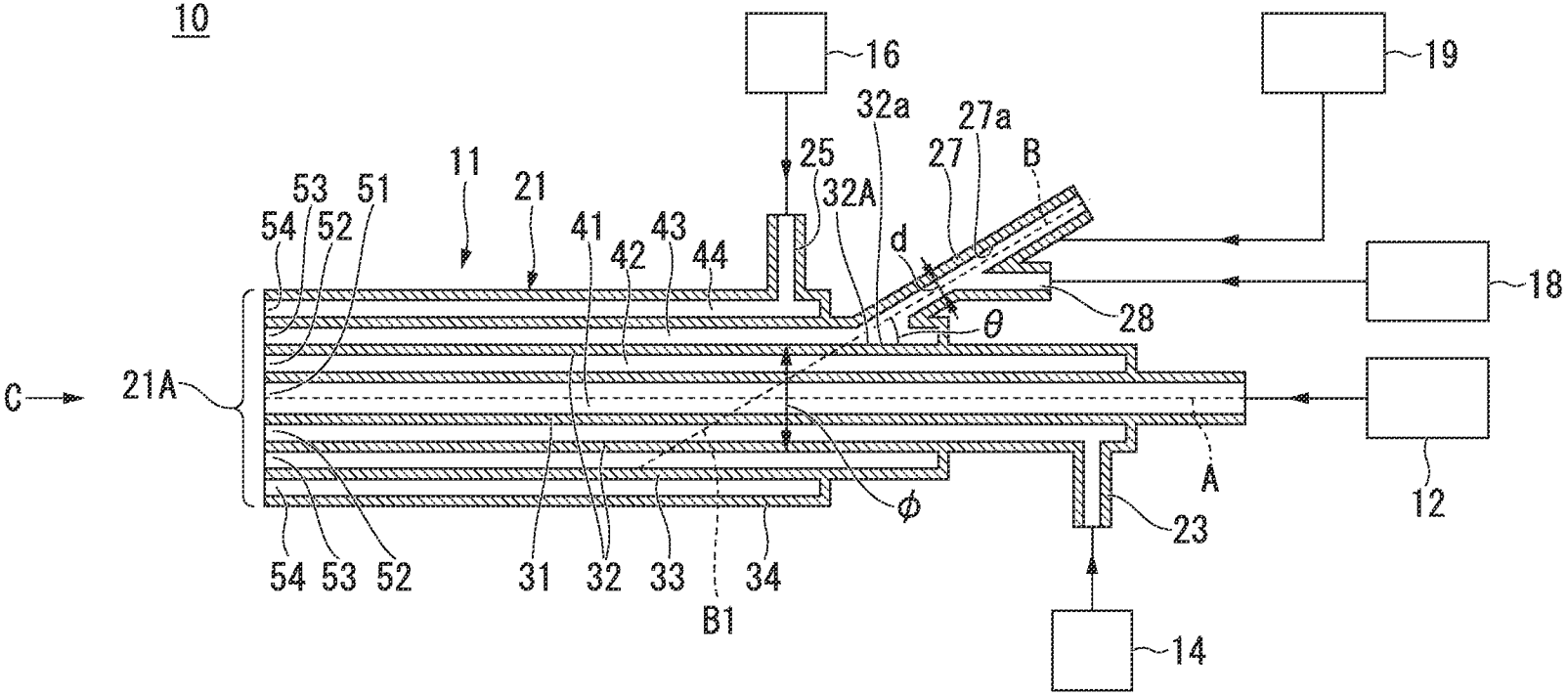
FIG. 1 is a cross-sectional view that schematically shows an overall configuration of a burner apparatus according to a first embodiment of the present invention.

FIG. 1 is a cross-sectional view that schematically shows an overall configuration of a burner apparatus according to a first embodiment of the present invention.

As can be seen from reference to FIG. 1, a burner apparatus 10 of the first embodiment includes a combustion burner 11, a first burnable fluid supply source 12, a fuel fluid supply source 14, a second burnable fluid supply source 16, a raw material powder supply source 18, and a carrier gas supply source 19.

The combustion burner 11 includes a burner main body 21, a fuel fluid introduction port 23, a burnable fluid introduction port 25, a raw material powder introduction pipe 27, and a raw material powder introduction port 28.

The burner main body 21 is provided with first to fourth circular members 31 to 34 (a plurality of circular members). As a result of this, the burner main body 21 includes a first burnable fluid supply pathway 41, a fuel fluid supply pathway 42, a raw material powder supply pathway 43, a second burnable fluid supply pathway 44, a first burnable fluid-ejecting port 51, a fuel fluid-ejecting port 52, a raw material powder-ejecting port 53, and a second burnable fluid-ejecting port 54.

Among the first to fourth circular members 31 to 34, the first circular member 31 is a circular member with the smallest external diameter. Among the first to fourth circular members 31 to 34, the first circular member 31 is disposed furthest on an inner side.

The second circular member 32 is disposed on an outer side of the first circular member 31 so that a cylindrical space is formed between the second circular member 32 and the first circular member 31. The second circular member 32 is a second raw material powder supply pathway-partitioning circular member that partitions an inner side of the raw material powder supply pathway 43.

The second circular member 32 is configured so that the length thereof is shorter than that of the first circular member 31. A rear end of the second circular member 32 is bent in an L shape, and is connected to an external wall of the first circular member 31.

Raw material powder that is introduced from the raw material powder introduction pipe 27 collides with an external wall 32A of the second circular member 32.

In such an instance, the external diameter of a portion of the second circular member 32 with which the raw material powder collides may be made larger than the external diameter of a portion with which the raw material powder does not collide. As a result of this, it is possible to further facilitate the dispersal of the raw material powder.

In addition, a separate member (for example, a metal circular pipe such as an abrasion-resistant SUS (stainless steel), a circular pipe that is made from the same material as the raw material powder that collides therewith, or the like) that is not shown in the drawings may be provided on a surface of a portion of the external wall 32A of the second circular member 32 with which the raw material powder collides. As a result of this, by causing the raw material powder to collide with the separate member, it is possible to facilitate the dispersal of the raw material powder. In addition, by setting a design in which only a collision portion is exchangeable, it is possible to restrict the influence of damage due to abrasion to a minimum.

The third circular member 33 is disposed on an outer side of the second circular member 32 so that a cylindrical space is formed between the third circular member 33 and the second circular member 32. The third circular member 33 is a first raw material powder supply pathway-partitioning circular member that partitions an outer side of the raw material powder supply pathway 43.

The third circular member 33 is configured so that the length thereof is shorter than that of the second circular member 32. A rear end of the third circular member 33 is bent in an L shape, and is connected to an external wall of the second circular member 32.

The fourth circular member 34 is disposed on an outer side of the third circular member 33 so that a cylindrical space is formed between the fourth circular member 34 and the second circular member 33. The fourth circular member 34 is configured so that the length thereof is shorter than that of the third circular member 33. A rear end of the fourth circular member 34 is bent in an L shape, and is connected to an external wall of the third circular member 33.

The first to fourth circular members 31 to 34 (the plurality of circular members) are disposed concentrically with respect to a central axis A of the burner main body 21. In addition, leading end surfaces of the first to fourth circular members 31 to 34 are configured to be flush with one another. A leading end 21A of the burner main body 21 is configured by the leading ends of the first to fourth circular members 31 to 34. A flame (not shown in the drawings) is formed at the leading end 21A of the burner main body 21.

The first burnable fluid supply pathway 41 is a columnar pathway that is formed inside the first circular member 31. The first burnable fluid supply pathway 41 is connected to the first burnable fluid supply source 12 that supplies a burnable fluid.

The fuel fluid supply pathway 42 is the cylindrical space that is formed between the first circular member 31 and the second circular member 32. The fuel fluid supply pathway 42 is connected to the fuel fluid supply source 14 that supplies the fuel fluid via the fuel fluid introduction port 23.

The raw material powder supply pathway 43 is the cylindrical space that is formed between the second circular member 32 and the third circular member 33. The raw material powder supply pathway 43 is disposed between the fuel fluid supply pathway 42 and the second burnable fluid supply pathway 44.

The raw material powder is introduced into the raw material powder supply pathway 43 via the raw material powder introduction pipe 27. The raw material powder supply pathway 43 is a pathway that supplies the raw material powder to the raw material powder-ejecting port 53.

The second burnable fluid supply pathway 44 is the cylindrical space that is formed between the third circular member 33 and the fourth circular member 34. The second burnable fluid supply pathway 44 is connected to the second burnable fluid supply source 16 that supplies a second burnable fluid via the burnable fluid introduction port 25.

The abovementioned first burnable fluid supply pathway 41, fuel fluid supply pathway 42, raw material powder supply pathway 43 and second burnable fluid supply pathway 44 (a plurality of pathways) are disposed concentrically with respect to the central axis A of the burner main body 21.

Figure 2:
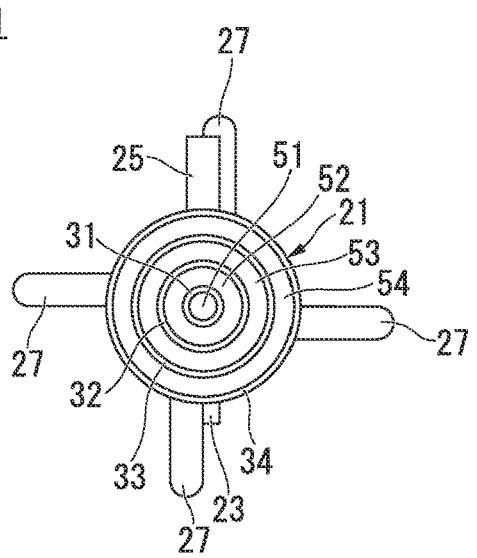
FIG. 2 is a view showing a cross-section of a combustion burner of the first embodiment that is shown in FIG. 1.

FIG. 2 is a view showing a cross-section of a combustion burner of the first embodiment that is shown in FIG. 1. In FIG. 2, constituent portions that are the same as those of the combustion burner 11 that is shown in FIG. 1 are given the same symbols.

As can be seen from reference to FIG. 1 and FIG. 2., the first burnable fluid-ejecting port 51 is configured by the leading end of the first circular member 31. The first burnable fluid-ejecting port 51 is disposed at the leading end of the first burnable fluid supply pathway 41. As a result of this, the first burnable fluid-ejecting port 51 is set to be integral with the first burnable fluid supply pathway 41.

The form of the first burnable fluid-ejecting port 51 can, for example, be set to a columnar shape. The first burnable fluid-ejecting port 51 ejects a first burnable fluid that is supplied by the first burnable fluid supply pathway 41.

The fuel fluid-ejecting port 52 is configured by the leading ends of the first and second circular members 31 and 32.

The fuel fluid-ejecting port 52 is disposed at a leading end of the fuel fluid supply pathway 42. As a result of this, the fuel fluid-ejecting port 52 is set to be integral with the fuel fluid supply pathway 42. The fuel fluid-ejecting port 52 ejects a fuel fluid that is supplied from the fuel fluid supply pathway 42.

The raw material powder-ejecting port 53 is configured by the leading ends of the second and third circular members 32 and 33.

The raw material powder-ejecting port 53 is disposed at a leading end of the raw material powder supply pathway 43. As a result of this, the raw material powder-ejecting port 53 is set to be integral with the raw material powder supply pathway 43. The raw material powder-ejecting port 53 ejects the raw material powder that is supplied from the raw material powder supply pathway 53.

The second burnable fluid-ejecting port 54 is configured by the leading ends of the third and fourth circular members 33 and 34. The second burnable fluid-ejecting port 54 is disposed at a leading end of the second burnable fluid supply pathway 44. As a result of this, the second burnable fluid-ejecting port 54 is set to be integral with the second burnable fluid supply pathway 44. The second burnable fluid-ejecting port 54 ejects the second burnable fluid that is supplied from the second burnable fluid supply pathway 44.

The forms of the abovementioned fuel fluid-ejecting port 52, raw material powder-ejecting port 53, and second burnable fluid-ejecting port 54 are set to be ring shaped (refer to FIG. 2).

In particular, by setting the raw material powder-ejecting port 53 to a simple ring shape, since the surface area of the raw material powder-ejecting port 53 is a maximum, it is possible to improve the dispersibility of the raw material powder.

Additionally, in FIG. 2, the combustion burner 11 is illustrated with a ring shape given as an example of a form of the fuel fluid-ejecting port 52, the raw material powder-ejecting port 53 and the second burnable fluid-ejecting port 54, but the form of the fuel fluid-ejecting port 52, the raw material powder-ejecting port 53 and the second burnable fluid-ejecting port 54 is not limited to this.

For example, in place of a ring-shaped form, a circular form, an elliptical form, or a polygonal form or the like in which a plurality of holes are disposed concentrically may be used as the fuel fluid-ejecting port 52, the raw material powder-ejecting port 53 and the second burnable fluid-ejecting port 54.

The fuel fluid introduction port 23 is provided in an external wall of the second circular member 32, and protrudes in a direction that becomes separated from the second circular member 32 on an outer side of the second circular member 32. The fuel fluid introduction port 23 is connected to the fuel fluid supply source 14 that supplies the fuel fluid.

The burnable fluid introduction port 25 is provided in an external wall of the fourth circular member 34, and protrudes in a direction that becomes separated from the fourth circular member 34 on an outer side of the fourth circular member 34. The burnable fluid introduction port 25 is connected to the second burnable fluid supply source 16 that supplies the second burnable fluid.

The raw material powder introduction pipe 27 is provided in an external wall of the third circular member 33 in a state in which the raw material powder can be introduced into the raw material powder supply pathway 43. The raw material powder introduction pipe 27 protrudes from the third circular member 33 on an outer side of the third circular member 33.

The raw material powder introduction pipe 27 is disposed so as to be inclined so that an angle θ that is formed by a central axis B of the raw material powder introduction pipe 27 and an external surface 32*a* of the second circular member 32 is an angle that is larger than 0° and smaller than 90°.

In addition, the raw material powder introduction pipe 27 is disposed so that an axis B1 that extends from the central axis B of the raw material powder introduction pipe 27 does not intersect the central axis A of the burner main body 21. Additionally, this point will be described in more detail below.

In this manner, by setting the angle θ that is formed by the central axis B of the raw material powder introduction pipe 27 and the external surface 32*a* of the second circular member 32 to be larger than 0° and smaller than 90°, and further disposing the raw material powder introduction pipe 27 so that the axis B1 that extends from the central axis B of the raw material powder introduction pipe 27 does not intersect the central axis A of the burner main body 21, it is possible to uniformly disperse the raw material powder inside the raw material powder supply pathway 43 in a circumferential direction (a horizontal direction) of the raw material powder supply pathway 43 by causing the raw material powder to collide with the external wall 32A of the second circular member 32.

As a result of this, since it is possible to eject dispersed raw material powder from the raw material powder-ejecting port 53, it is possible to efficiently heat the raw material powder using a flame and/or a high temperature region in the vicinity of the flame (hereinafter, referred to as a "flame region").

In addition, since it is not necessary to use a large volume vapor flow (a vapor for raw material powder transport) in the dispersal of the raw material powder, the configuration of the combustion burner 11 is not complicated.

In other words, it is possible to efficiently perform heating of the raw material powder by improving the dispersibility of the raw material powder that is ejected from the raw material powder-ejecting port 53 using a simple configuration.

It is preferable that the angle θ that is formed by the central axis B of the raw material powder introduction pipe 27 and the external surface 32*a* of the second circular member 32 be set to be 10° or more and less than 60°.

If the angle θ is smaller than 10°, a ratio of the raw material powder that collides with the external wall 32A of the second circular member 32 becomes small. In addition, in a case in which the combustion burner 11 is set so that the leading end 21A points downward, and the raw material powder is heated, if the angle θ is smaller than 10°, the combustion burner 11 lengthened.

In addition, in a case in which the combustion burner 11 is set so that the leading end 21A points downward, and the raw material powder is heated, if the angle θ is 60° or more, there is a concern that the inside of the raw material powder introduction pipe 27 will become blocked with the raw material powder.

In addition, it is more preferable that an angle θ that is formed by the central axis B of the raw material powder introduction pipe 27 and the external surface of the third circular member 33 be set to be 10° or more and less than 45°.

If the angle θ is 45° or more, since there is a concern that the raw material powder introduction pipe 27 will pulsate, there is a concern that the dispersibility of the raw material powder will be reduced.

Additionally, judging from a viewpoint of easily performing design of the combustion burner 11 and manufacture of the combustion burner 11, and a viewpoint of blockages of the raw material powder introduction pipe 27, it is most preferable that the angle θ be 30°.

The form of the raw material powder introduction pipe 27 may be a tubular form, or may be a rectangular tube.

Figure 3:
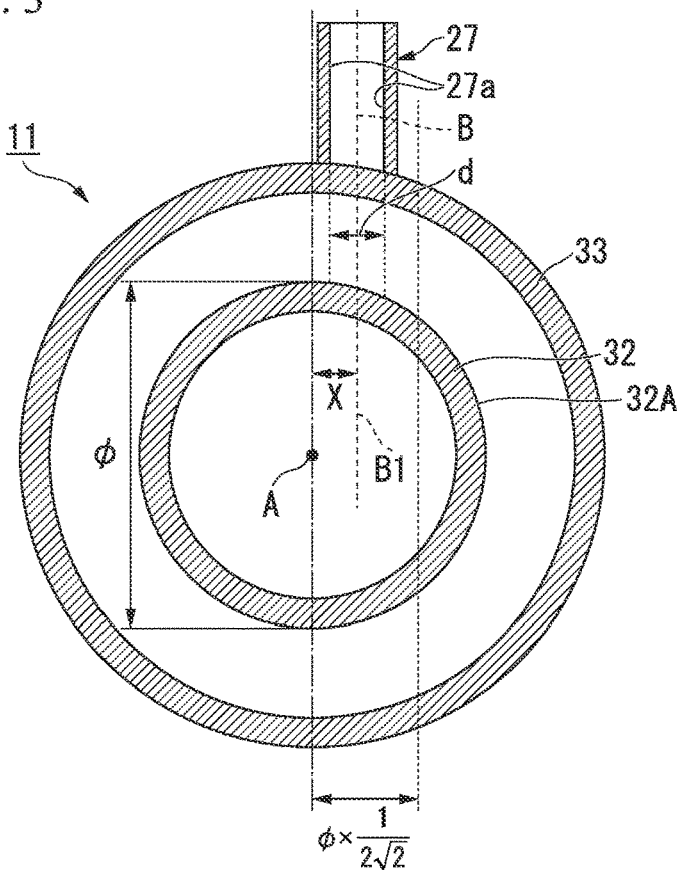
FIG. 3 is a schematic cross-sectional view of the combustion burner for describing a positional relationship between a raw material powder introduction pipe and a central axis of a burner main body.

FIG. 3 is a schematic cross-sectional view of the combustion burner for describing a positional relationship between a raw material powder introduction pipe and a central axis of a burner main body.

Figure 4:
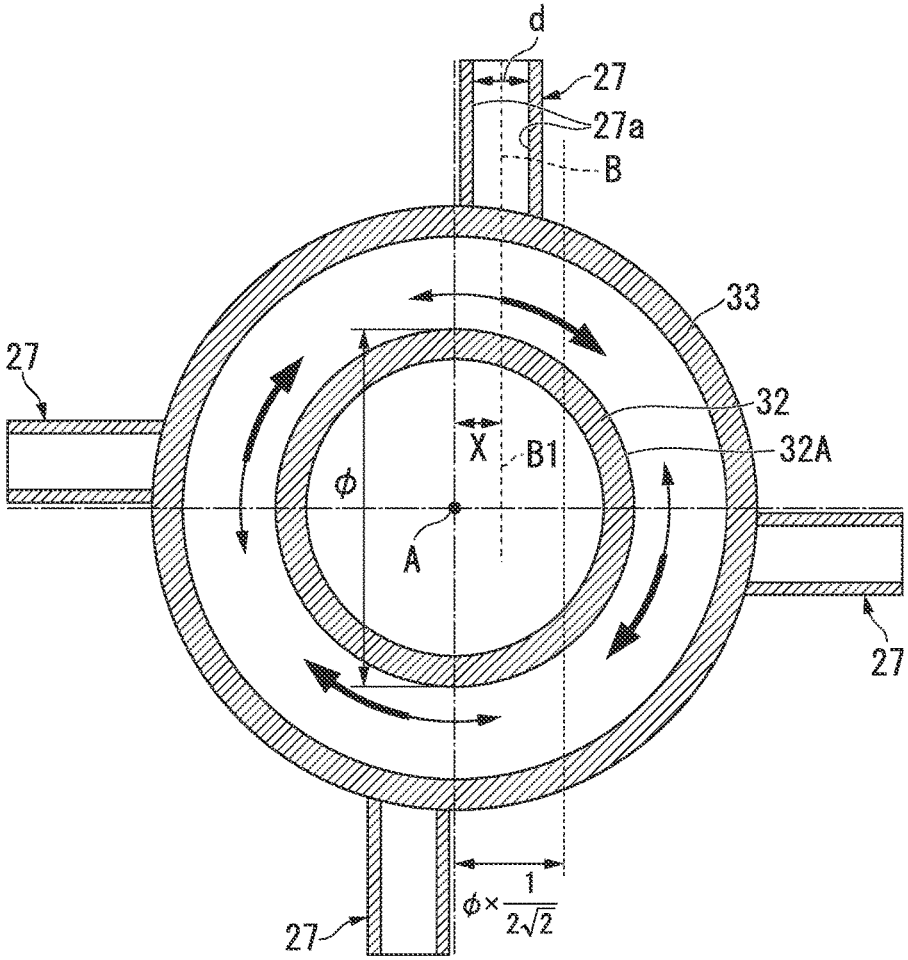
FIG. 4 is a schematic cross-sectional view of the combustion burner for describing the dispersibility of the raw material powder being homogenized in the positional relationship between the raw material powder introduction pipes and the central axis of the burner main body that are shown in FIG. 3.

FIG. 4 is a schematic cross-sectional view of the combustion burner for describing the dispersibility of the raw material powder being homogenized in the positional relationship between the raw material powder introduction pipes and the central axis of the burner main body that are shown in FIG. 3.

Figure 5:
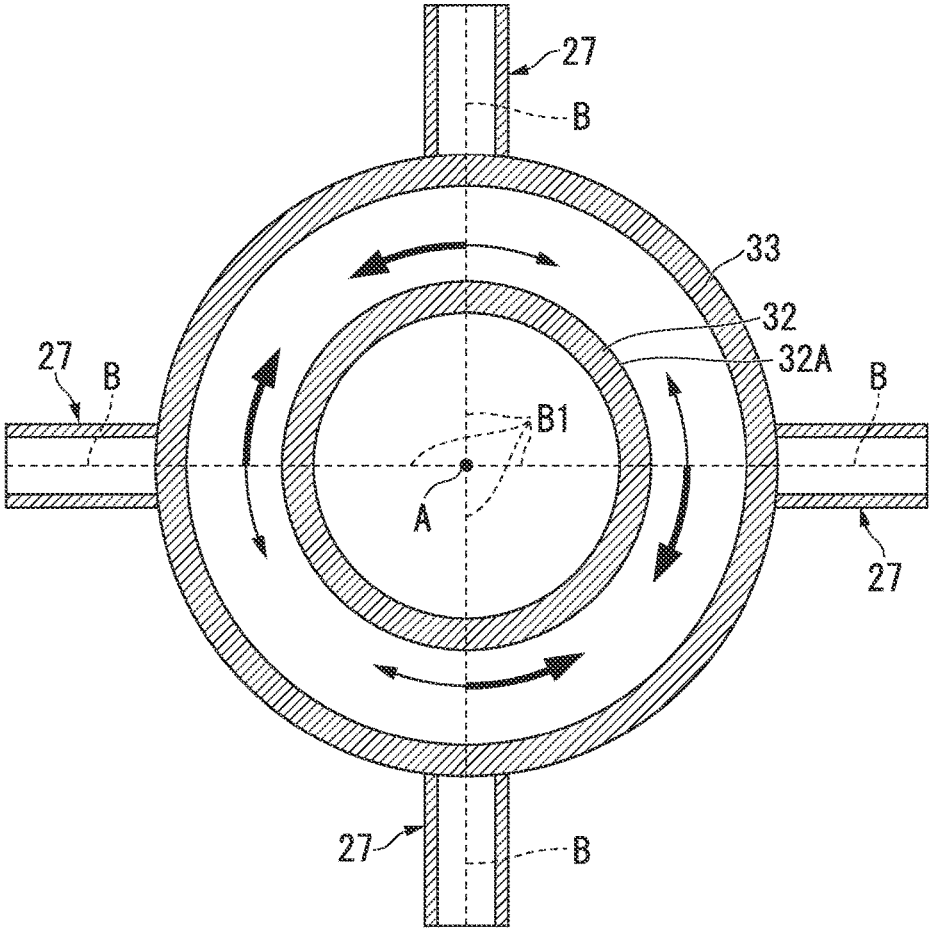
FIG. 5 is a schematic cross-sectional view of the burner for describing the dispersibility of the raw material powder deteriorating when a combustion burner that is set to a configuration in which axes that extend from central axes of the raw material powder introduction pipes and a central axis of the burner main body intersect is used.

FIG. 5 is a schematic cross-sectional view of the burner for describing the dispersibility of the raw material powder deteriorating when a combustion burner that is set to a configuration in which axes that extend from central axes of the raw material powder introduction pipes and a central axis of the burner main body intersect is used.

In other words, FIG. 3 and FIG. 4 are combustion burners in which the structure of the present invention is applied, and FIG. 5 is a combustion burner in which the structure of the present invention is not applied.

In FIG. 3 to FIG. 5, only constituent elements that are necessary in the description are illustrated. In addition, in FIG. 3 to FIG. 5, constituent portions that are the same as those of the combustion burner 11 that is shown in FIG. 1 and FIG. 2 are given the same symbols. The symbol x that is shown in FIG. 3 and FIG. 4 shows a distance (hereinafter, referred to as a "distance x") between axis B1 that extends from the central axis B of the raw material powder introduction pipe 27 and the central axis A of the burner main body 21.

As a result of the investigation of the present inventors, it is favorable if the raw material powder introduction pipe 27 and the second circular member 32 are configured so that a relationship between an internal diameter d (the internal diameter in a case in which the form of the raw material powder introduction pipe 27 is a tubular shape, and the width between opposing inner walls in a case in which the form of the raw material powder introduction pipe 27 is a rectangular tube) of the raw material powder introduction pipe 27 and an external diameter ϕ of the second circular member 32 satisfies Expression (2) below.

$$\phi > 2d \tag{2}$$

By setting so that the relationship between the internal diameter d of the raw material powder introduction pipe 27 and an external diameter ϕ of the second circular member 32 satisfies the abovementioned Expression (2), it is possible to reliably cause the raw material powder to collide with the external wall 32A of the second circular member 32.

In addition, as a result of further investigation of the present inventors, it is favorable if the raw material powder introduction pipe 27 is disposed so that the relationship between the internal diameter d of the raw material powder introduction pipe 27 and the external diameter ϕ of the second circular member 32 satisfies Expression (3) below, and as shown in FIG. 3, the entire extension length of an inner wall surface 27*a* of the raw material powder introduction pipe 27 passes through a range of a distance of two times the square root of half of ϕ from the central axis A of the burner main body 21.

$$\theta > 2\sqrt{2} \times d \tag{3}$$

By disposing the raw material powder introduction pipe 27 so that the entire extension length of the inner wall surface 27*a* of the raw material powder introduction pipe 27 passes through a range of a distance of two times the square root of half of ϕ from the central axis A of the burner main body 21, since it is possible to suppress a situation in which the raw material powder flows along the external wall 32A of the second circular member 32, it is possible to sufficiently disperse the raw material powder. As a result of this, it is possible to sufficiently heat the raw material powder in the flame region.

It is favorable if a plurality (more specifically, an even number that is two or more) of the raw material powder introduction pipe 27 are provided in the third circular member 33 so as to be rotationally symmetrical to the central axis A of the burner main body 21 (refer to FIG. 2).

In this manner, by providing two or more raw material powder introduction pipes 27 in the third circular member 33 so as to be rotationally symmetrical, it is possible to reduce unevenness of remaining raw material powder, and therefore, to create balance in a rotationally symmetrical manner.

As a result of this, since it is possible to insert the raw material powder into the flame region in a more dispersed state, it is possible to heat the raw material powder more efficiently.

In addition, since the plurality of raw material powder introduction pipes 27 are disposed so that axes B1 that extend from central axes B of the raw material powder introduction pipes 27 do not intersect a central axis A of the burner main body 21, and since, as shown in FIG. 4, a collision position of the raw material powder on the external wall 32A of the second circular member 32 is fixed in a right rotational direction or a left rotational direction, it is possible to eliminate unevenness of the raw material powder that remains after collision of the raw material powder in a rotationally symmetrical manner, and therefore, it is possible to eject sufficiently dispersed raw material powder from the raw material powder-ejecting port 53 (refer to FIG. 1 and FIG. 2).

As shown in FIG. 5, in a case in which the raw material powder introduction pipes 27 are disposed so that the central axis A of the burner main body 21 and the axes B1 that extend from the central axes B of the raw material powder introduction pipes 27 intersect, minor changes in the collision position of the raw material powder have an influence, and therefore, it becomes uncertain whether the raw material powder will be dispersed in the right rotational direction or the left rotational direction.

Therefore, even if a plurality of raw material powder introduction pipes 27 are disposed in a rotationally symmetrical manner, there are cases in which the unevenness of adjacent raw material powder introduction pipes 27 overlaps, and the dispersibility of the raw material powder is reduced.

The raw material powder introduction port 28 is provided in the external wall of the raw material powder introduction pipe 27. The raw material powder introduction port 28 is connected to the raw material powder supply source 18. The raw material powder introduction port 28 causes the raw material powder that is supplied from the raw material powder supply source 18 to be introduced into the raw material powder introduction pipe 27.

The first burnable fluid supply source 12 is connected to the first circular member 31 in a state of being capable of supplying the first burnable fluid to the inside of the first circular member 31. As the first burnable fluid, for example, it is possible to use a burnable gas. As the burnable gas, for example, it is possible to use oxygen, air or a gas in which the two are mixed.

The fuel fluid supply source 14 is connected to the fuel fluid introduction port 23 in a state of being capable of supplying the fuel fluid to the fuel fluid introduction port 23. As the fuel fluid, for example, it is possible to use a vapor fuel such as methane gas, propane gas, city gas, or LPG (Liquefied petroleum gas), a liquid fuel such as kerosene or crude oil, a solid fuel such as a pulverized coal that is transported in vapor, or a fuel in which a plurality of the abovementioned fuels are combined.

The second burnable fluid supply source 16 is connected to the burnable fluid introduction port 25 in a state of being capable of supplying the second burnable fluid to the inside of the burnable fluid introduction port 25. As the second burnable fluid, for example, it is possible to use a burnable gas. As the burnable gas, for example, it is possible to use oxygen, air or a gas in which the two are mixed.

The raw material powder supply source 18 is connected to the raw material powder introduction port 28 in a state of being capable of supplying the raw material powder to the raw material powder introduction port 28.

In this instance, the "raw material powder" in the present invention will be described. The raw material powder in the present invention is a powder for which heating is required, and refers to solid matter in which the particle diameter is 10 mm or less, or solid matter of 10 nm or more in which there is no Brownian motion.

In addition, examples of the raw material powder in the present invention include a gel form substance, a substance in which a liquid or a vapor has been solidified, a substance in which the two are combined, a substance that is referred to as dust, granules, fine powder or ultrafine powder, a substance in which two or more of these are bonded together, or a substance in which these have become aggregated.

Furthermore, examples of the raw material powder in the present invention include a metal or a metal compound, ceramics, trash, glass, pulverized coal, a solid fuel, a food powder such as wheat flour, a substance in which water, an aqueous solution, an organic solvent, a liquid fuel or the like has been solidified, a substance in which these raw material powders or raw material liquid droplets have been solidified, products thereof, or a substance in which a plurality of these are combined.

In addition, examples of the raw material powder of the present invention also includes substances in which a form changes due to any of the phenomena of combustion, oxidation, reduction, chemical reactions, melting, evaporation, or sublimation as a result of heating with the flame that the combustion burner 11 forms.

The carrier gas supply source 19 supplies a carrier gas that transports the raw material powder according to necessity inside the raw material powder introduction pipe 27 via an introduction port that is provided in the raw material powder introduction pipe 27 but not shown in the drawings. As the carrier gas, for example, it is possible to use a burnable gas such as oxygen or air, a fuel gas such as city gas, methane or LPG, a non-volatile gas such as nitrogen, or a gas in which these are combined.

In a case in which the combustion burner 11 is used in a vertically downward manner (a case in which a direction of the central axis A of the burner main body 21 coincides with a vertical direction), since it is possible to eject the raw material powder in a free-falling manner, the carrier gas supply source 19 is not necessary, but even in this case, the carrier gas supply source 19 may be provided according to necessity, and the raw material powder may be ejected using a carrier gas.

Additionally, in a case in which the carrier gas is used in the supply of the raw material powder, it is preferable that a supply amount (a flow amount) of the carrier gas be set so that an ejecting rate of the carrier gas that is ejected from the combustion burner 11 is 5 m/second or less, and 2 m/second or less is more preferable.

In this manner, by ejecting the raw material powder with the carrier gas from the raw material powder-ejecting port 53 at an ejecting rate of 5 m/second or less, which is slower than the ejecting rate (10 m/second or more) of the carrier gas of a case of the related art in which the raw material powder is ejected at high speed, or at an even slower ejecting rate of 2 m/second or less, since it is possible to suppress the ejecting rate of the raw material powder, it is possible to sufficiently heat the raw material powder that is ejected from the raw material powder-ejecting port 53.

According to the burner apparatus of the first embodiment, by setting the angles θ that are formed by the central axes B of the raw material powder introduction pipes 27 and the external surface 32*a* of the second circular member 32 to be larger than 0° and smaller than 90°, and further disposing the raw material powder introduction pipes 27 so that the axes B1 that extend from the central axes B of the raw material powder introduction pipes 27 do not intersect the central axis A of the burner main body 21, it is possible to uniformly disperse the raw material powder inside the raw material powder supply pathway 43 in a circumferential direction (a horizontal direction) of the raw material powder supply pathway 43 by causing the raw material powder to collide with external wall 32A of the second circular member 32.

As a result of this, since it is possible to eject dispersed raw material powder from the raw material powder-ejecting port 53, it is possible to efficiently heat the raw material powder using the flame region.

In addition, since it is not necessary to use a high-speed vapor flow (a vapor for transport) in the dispersal of the raw material powder, the configuration of the combustion burner 11 is not complicated.

In other words, it is possible to efficiently perform heating of the raw material powder by improving the dispersibility of the raw material powder that is ejected from the raw material powder-ejecting port 53 using a simple configuration.

Next, a raw material powder-heating method of the first embodiment will be described with reference to FIG. 1 and FIG. 2.

Firstly, the flame is formed at the leading end 21A of the burner main body 21 by ejecting the fuel fluid from the fuel fluid-ejecting port 52 in addition to ejecting the first and second burnable gasses from the first and second burnable fluid-ejecting ports 51 and 54.

Subsequently, the raw material powder is introduced inside the raw material powder introduction pipe 27 via the raw material powder introduction port 28.

Next, the raw material powder that is introduced into the raw material powder introduction pipe 27, is introduced into the raw material powder supply pathway 43 in a direction that is inclined at an angle of larger than 0° and smaller than 90°, and from a direction that does not intersect the central axis A of the burner main body 21 (a raw material powder introduction step).

Thereafter, the raw material powder that was introduced into the raw material powder supply pathway 43 collides with the external wall 32A of the second circular member 32. As a result of this, it is possible to uniformly disperse the raw material powder inside the raw material powder supply pathway 43.

Next, the raw material powder is heating by the flame (the flame region) by ejecting the raw material powder that is supplied by the raw material powder supply pathway 43 from the raw material powder-ejecting port 53 (the heating step).

According to the raw material powder-heating method of the first embodiment, as a result of the method including a raw material powder introduction step of introducing the raw material powder into the raw material powder supply pathway 43 in a direction that is inclined at an angle of larger than 0° and smaller than 90° with respect to the raw material powder supply pathway 43, which is formed in a tubular shape, and from a direction that does not intersect the central axis A of the burner main body 21, and a heating step of heating the raw material powder using the flame (the flame region) by ejecting the raw material powder that is supplied by the raw material powder supply pathway 43 from the raw material powder-ejecting port 53, it is possible to uniformly disperse the raw material powder inside the raw material powder supply pathway 43 in a circumferential direction (a horizontal direction) of the raw material powder supply pathway 43 by causing the raw material powder to collide with external wall 32A of the second circular member 32.

As a result of this, since it is possible to eject dispersed raw material powder from the raw material powder-ejecting port 53, it is possible to efficiently heat the raw material powder using the flame region.

In addition, since it is not necessary to use a high-speed vapor flow (a vapor for transport) in the dispersal of the raw material powder, the configuration of the combustion burner 11 is not complicated.

In other words, it is possible to efficiently perform heating of the raw material powder by improving the dispersibility of the raw material powder that is ejected from the raw material powder-ejecting port 53 using a simple configuration.

Second Embodiment

Figure 6:
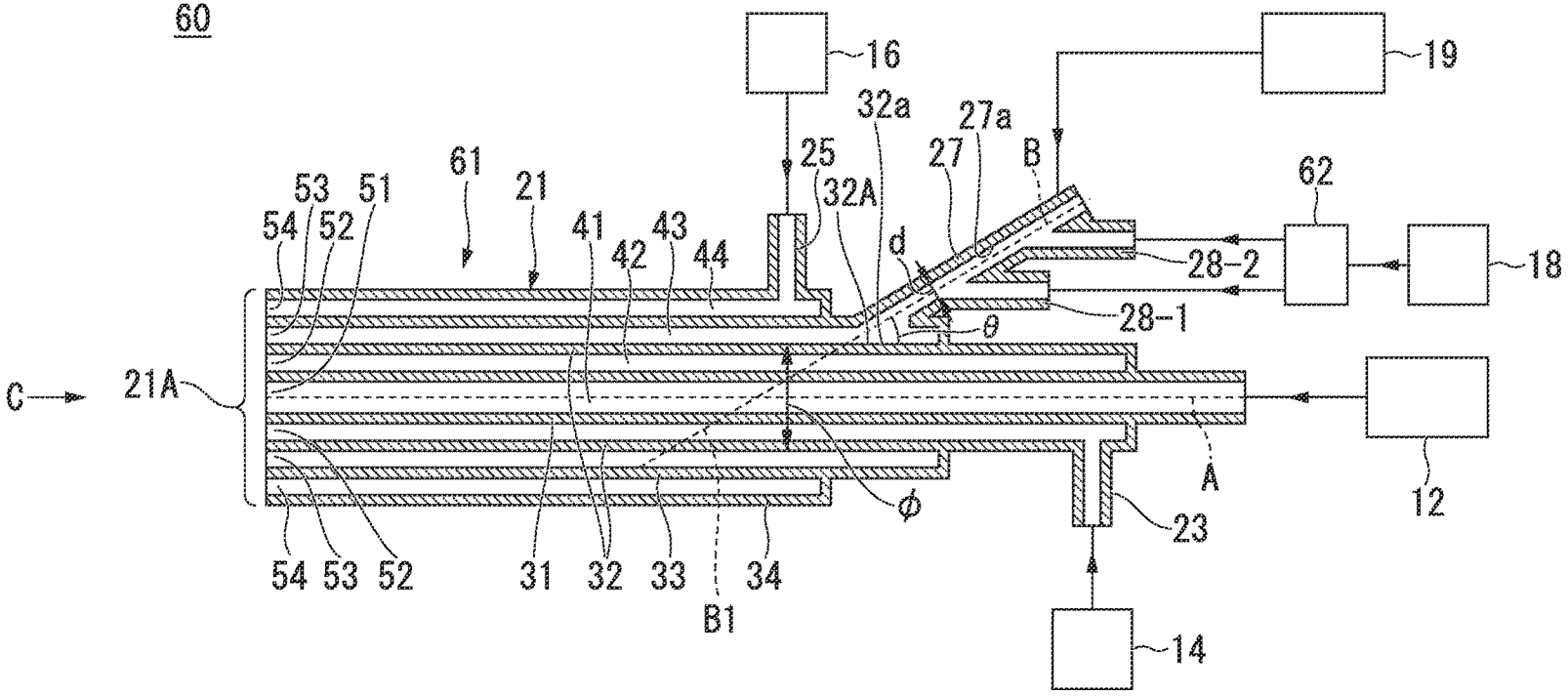
FIG. 6 is a cross-sectional view that schematically shows an overall configuration of a burner apparatus according to a second embodiment of the present invention.

FIG. 6 is a cross-sectional view that schematically shows an overall configuration of a burner apparatus according to a second embodiment of the present invention. In FIG. 6, constituent portions that are the same as those of the burner apparatus 10 of the first embodiment that is shown in FIG. 1 are given the same symbols.

As can be seen from reference to FIG. 6, other than including a combustion burner 61 in place of the combustion burner 11 that configures the burner apparatus 10 of the first embodiment, and including a raw material powder distributor 62, a burner apparatus 60 of the second embodiment has a similar configuration to that of the burner apparatus 10.

Other than including a raw material powder introduction port 28-1 and a raw material powder introduction port 28-2 in place of the raw material powder introduction port 28, the combustion burner 61 has a similar configuration to that of the combustion burner 11 of the first embodiment.

The raw material powder introduction ports 28-1 and 28-2 are set to have similar configurations to that of the raw material powder introduction port 28 that was described in the first embodiment. The raw material powder introduction ports 28-1 and 28-2 are provided in a single raw material powder introduction pipe 27. In other words, two raw material powder introduction ports (the raw material powder introduction ports 28-1 and 28-2) are provided in a single raw material powder introduction pipe 27.

In FIG. 6, a case in which the two raw material powder introduction ports (the raw material powder introduction ports 28-1 and 28-2 in the case of FIG. 6) are provided in a single raw material powder introduction pipe 27 is illustrated as an example, but it is favorable if an even number of the raw material powder introduction ports 28-1 and 28-2 is provided in a single raw material powder introduction pipe 27.

Figure 7:
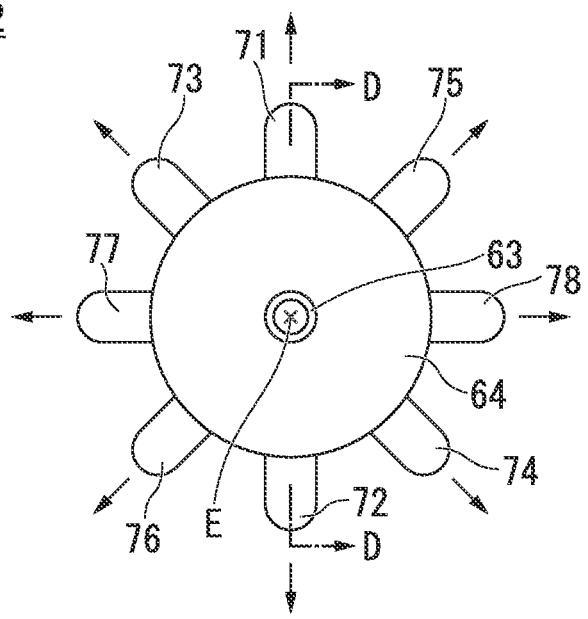
FIG. 7 is a plan view of a raw material powder distributor (a view in which the raw material powder distributor is viewed in plan form from an upper end side thereof).
Figure 8:
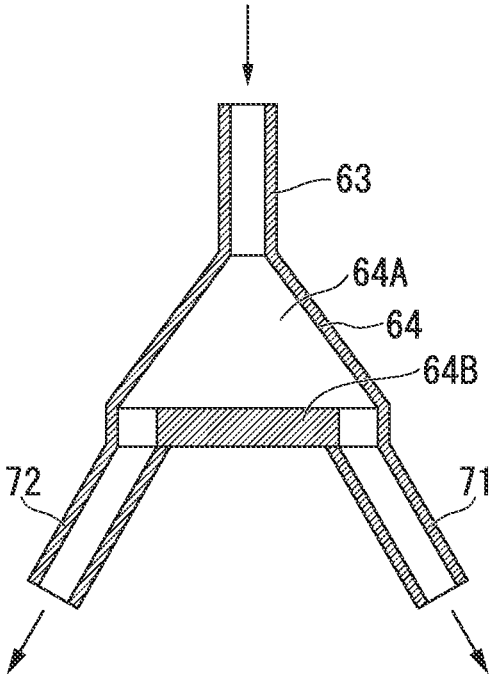
FIG. 8 is a cross-sectional view of a D-D line direction of the raw material powder distributor that is shown in FIG. 7.

FIG. 7 is a plan view of a raw material powder distributor (a view in which the raw material powder distributor is viewed in plan form from an upper end side thereof). FIG. 8 is a cross-sectional view of a D-D line direction of the raw material powder distributor that is shown in FIG. 7.

As can be seen from reference to FIG. 7 and FIG. 8, the raw material powder distributor 62 includes a raw material powder introduction unit 63, a raw material powder distribution unit 64, and raw material powder lead-out units 71 to 78 (a plurality of raw material powder lead-out units).

The raw material powder introduction unit 63 is set to have a cylindrical shape. The form of the raw material powder introduction unit 63 can be set to be tubular, for example, but is not limited to this. For example, the form of the raw material powder introduction unit 63 may be a rectangular tube.

The raw material powder introduction unit 63 is connected to the raw material powder supply source 18 that is shown in FIG. 6. The raw material powder is supplied to the raw material powder introduction unit 63 from the raw material powder supply source 18.

The raw material powder distribution unit 64 is disposed between the raw material powder introduction unit 63 and the raw material powder lead-out units 71 to 78. The raw material powder distribution unit 64 is set to have a wide profile from the raw material powder introduction unit 63 toward the raw material powder lead-out units 71 to 78.

The raw material powder distribution unit 64 includes a space 64A (a space that is formed in a wide profile from the raw material powder introduction unit 63 toward the raw material powder lead-out units 71 to 78) that distributes the raw material powder to the raw material powder lead-out units 71 to 78. In addition, the raw material powder distribution unit 64 includes a bottom plate 64B.

The raw material powder lead-out units 71 to 78 are provided in the bottom plate 64B of the raw material powder distribution unit 64. The raw material powder lead-out units 71 to 78 are disposed so as to be point-symmetrical to a center E of the raw material powder introduction unit 63 (refer to FIG. 7).

The raw material powder lead-out units 71 to 78 are disposed so as to be spread out on an outer side from a connection position with the raw material powder distribution unit 64.

In addition, the raw material powder introduction ports 28-1 and 28-2 (an even number of raw material powder introduction ports) that are disposed in the same raw material powder introduction pipe 27 are connected to the raw material powder lead-out units 71 and 72 that are disposed so as to be point-symmetrical to the center E of the raw material powder introduction unit 63.

More specifically, the raw material powder introduction port 28-1 is connected to the raw material powder lead-out unit 71, and the raw material powder introduction port 28-2 is connected to the raw material powder lead-out unit 72.

Additionally, although not illustrated in the drawings, the raw material powder lead-out units 73 to 78 are connected to raw material powder introduction ports (not shown in the drawings) that are provided in other raw material powder introduction pipes 27 that are not shown in FIG. 6.

By using a raw material powder distributor 62 that is configured in the abovementioned manner, it is possible to introduce raw material powder that is ejected in a radial manner to a plurality of raw material powder introduction pipes 27 via the raw material powder introduction ports 28-1 and 28-2.

In addition, it is possible to eliminate point-symmetrical unevenness, which is caused by using the raw material powder distributor 62, by connecting the raw material powder distributor 62 to the same raw material powder introduction pipe 27, and transporting the distributed raw material powder to the raw material powder lead-out units 71 to 78 which are disposed oppositely (for example, a combination of the raw material powder lead-out unit 71 and the raw material powder lead-out unit 72), or at a periods of N (N is an integer of two or more, and for example, a combination of the raw material powder lead-out units 71, 78, 72 and 77 when N=2). Therefore, it is even possible to uniformly supply the raw material powder to each raw material powder introduction pipe 27 when there is one raw material powder supply source 18.

According to the burner apparatus of the second embodiment, by providing the plurality (two in the case of FIG. 3) of raw material powder introduction ports 28-1 and 28-2 to a single raw material powder introduction pipe 27, it is possible to easily reduce the extent of unevenness in a supply amount of the raw material powder that is caused when using a plurality of raw material powder supply sources 18.

For example, by preparing 2×n raw material powder supply sources 18 for n raw material powder introduction pipes 27, which have the raw material powder introduction ports 28-1 and 28-2, and among the raw material powder supply sources 18, transporting the raw material powder by connecting pathways from the raw material powder supply sources 18 with the $k^{th}$ greatest supply amount of the raw material powder, and pathways from the raw material powder supply sources 18 with the $k^{th}$ smallest supply amount of the raw material powder to the raw material powder introduction ports 28-1 and 28-2 of the same raw material powder introduction pipe 27 (for example, connecting a raw material powder supply source 18 that supplies the greatest amount of the raw material powder, and a raw material powder supply source 18 that supplies the smallest amount of the raw material powder to the raw material powder introduction ports 28-1 and 28-2 so that the abovementioned raw material powder supply sources 18 are transported to the same raw material powder introduction pipe 27, and connecting a raw material powder supply source 18 that supplies the second greatest amount of the raw material powder, and a raw material powder supply source 18 that supplies the second smallest amount of the raw material powder to the raw material powder introduction ports 28-1 and 28-2 so that the abovementioned raw material powder supply sources 18 are transported to the same raw material powder introduction pipe 27), it is possible to largely eliminate unevenness in the supply amount of the raw material powder.

In this manner, by eliminating unevenness that is generated in the supply amount of the raw material powder through use of a plurality of raw material powder supply sources 18, it is possible to eject the raw material powder into the flame region in a more dispersed manner, and therefore, it is possible to efficiently heat the raw material powder.

In addition, the burner apparatus 60 that is configured in the abovementioned manner can obtain the same effects as the burner apparatus 10 of the first embodiment.

Next, a raw material powder-heating method of the second embodiment that uses the burner apparatus 60 that is shown in FIG. 6 will be described.

Other than including a step of distributing the raw material powder that is supplied from the raw material powder supply source 18 in a plurality using the raw material powder distributor 62 before the raw material powder introduction step that was described in the first embodiment, the raw material powder-heating method of the second embodiment can be performed using the same method as the raw material powder-heating method of the first embodiment.

In addition, since, according to the raw material powder-heating method of the second embodiment, it is possible to distribute the raw material powder more efficiently than the raw material powder-heating method of the first embodiment, it is possible to more efficiently heat the raw material powder.

Preferable embodiments of the present invention have been described in detail above, but the invention is not limited to these specific embodiments, and various modifications and alteration are possible within a range of the scope of the present invention that is disclosed in the claims.

EXPERIMENTAL EXAMPLE 1

In Experimental Example 1, an experiment was performed using combustion burners M1 to M7 that are mentioned below.

In this instance, the configurations of each of the combustion burners M1 to M7 will be described with reference to FIG. 1.

In the combustion burner M1, the central axis A of the burner main body 21 was designed to intersect the axis B1 that extends from the central axis B of the raw material powder introduction pipe 27.

In the combustion burner M2, the distance x between the axis B1 that extends from the central axis B of the raw material powder introduction pipe 27 and the central axis A of the burner main body 21 was designed so that the axis B1 and the central axis A are separated by a distance of one eighth of the external diameter ϕ of the second circular member 32 (refer to FIG. 3).

In the combustion burner M3, the distance x between the axis B1 that extends from the central axis B of the raw material powder introduction pipe 27 and the central axis A of the burner main body 21 was designed so that the axis B1 and the central axis A are separated by a distance of a quarter of the external diameter ϕ of the second circular member 32.

In the combustion burner M4, the distance x between the axis B1 that extends from the central axis B of the raw material powder introduction pipe 27 and the central axis A of the burner main body 21 was designed so that the axis B1 and the central axis A are separated by a distance of three eighths of the external diameter ϕ of the second circular member 32.

In the combustion burner M5, the distance x between the axis B1 that extends from the central axis B of the raw material powder introduction pipe 27 and the central axis A of the burner main body 21 was designed so that the axis B1 and the central axis A are separated by a distance of a half of the external diameter ϕ of the second circular member 32.

In the combustion burner M6, the distance x between the axis B1 that extends from the central axis B of the raw material powder introduction pipe 27 and the central axis A of the burner main body 21 and the external diameter ϕ of the second circular member 32 were set to be equivalent.

In the combustion burner M7, the distance x between the axis B1 that extends from the central axis B of the raw material powder introduction pipe 27 and the central axis A of the burner main body 21 was set to be 1.5 times the external diameter ϕ of the second circular member 32.

In the combustion burners M1 to M7, a number of raw material powder introduction pipes 27 was set to one, and the external diameter of the raw material powder introduction pipe 27 was set to be a quarter of the external diameter ϕ of the second circular member 32.

In addition, in the combustion burners M1 to M7, a thickness of the raw material powder introduction pipe 27 was set to be a thickness that was almost negligible with respect to the external diameter of the raw material powder introduction pipe 27.

In addition, in the combustion burners M1 to M7, the angle θ that is formed by the central axis B of the raw material powder introduction pipe 27 and the external surface 32*a* of the second circular member 32 was set to be 30°.

In addition, in the combustion burners M1 to M7, two raw material powder introduction ports 28-1 were provided in the raw material powder introduction pipe 27.

In addition, in the combustion burners M1 to M7, as the raw material powder-ejecting port 53, an ejecting port that had been opened into a ring shape was used.

The combustion burners M1 to M7 were disposed so that the leading end 21A of the burner main body 21 pointed downward (in other words, so that the central axis A of the burner main body 21 was in a vertical direction).

The experiment was performed using both a free-fall technique and a vapor flow transport technique as the supply method of the raw material powder.

As the carrier gas, in the vapor flow transport technique, oxygen was supplied so that an ejecting rate from the leading end 21A of the burner main body 21 was 4 m/second, and in the free-fall technique, in order to prevent blocking, oxygen was supplied so that an ejecting rate from the leading end 21A of the burner main body 21 was 1.5 m/second.

As the raw material powder, glass cullet that was set to a particle diameter of 1 μm to 5 mm ($D_{50}$: 300 μm or less) was used.

Other than the features described above, the combustion burners M1 to M7 used the same configurations as the burner apparatus 10 that is shown in FIG. 1.

Figure 9:
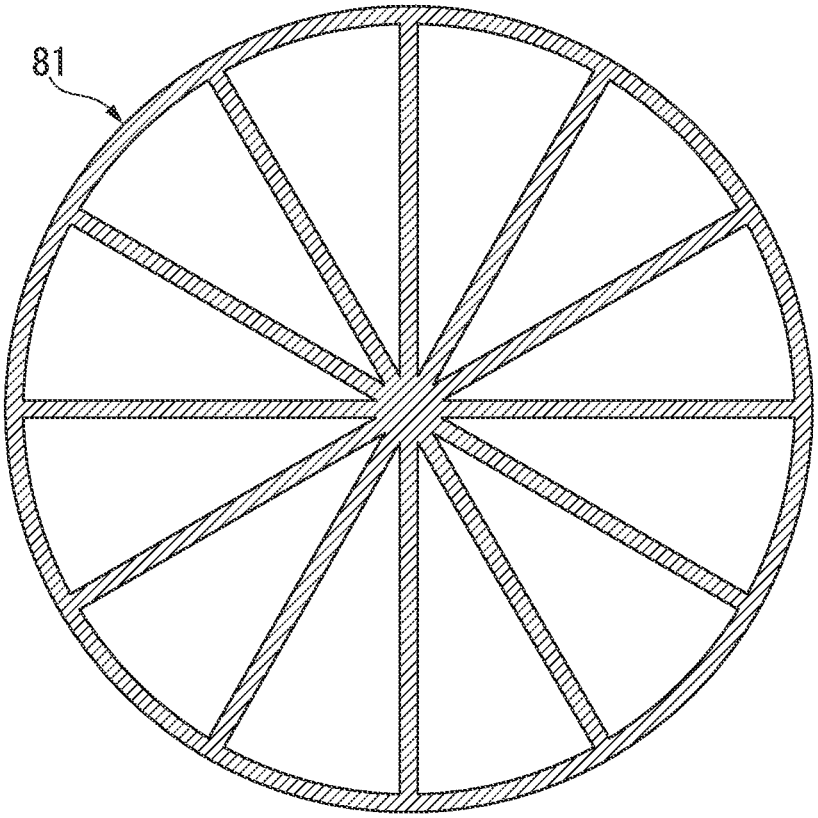
FIG. 9 is a plan view of a raw material powder receptor.
Figure 10:
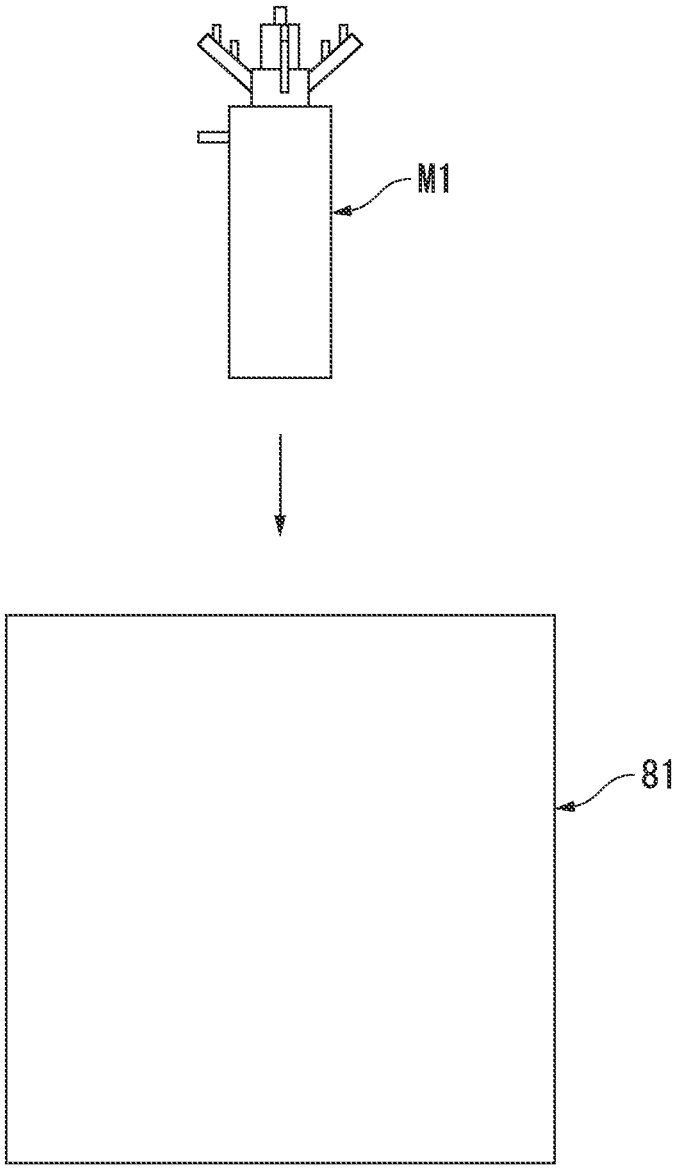
FIG. 10 is a view that schematically shows a positional relationship between a combustion burner and a raw material powder receptor when an ejecting amount of the raw material powder, which is ejected from the combustion burner using the raw material powder receptor that is shown in FIG. 9, is measured.

FIG. 9 is a plan view of a raw material powder receptor. FIG. 10 is a view that schematically shows a positional relationship between a combustion burner and a raw material powder receptor when an ejecting amount of the raw material powder, which is ejected from the combustion burner using the raw material powder receptor that is shown in FIG. 9, is measured.

In FIG. 10, the combustion burner M1 is illustrated as an example of the combustion burner, but after the measurement of the ejecting amount of the raw material powder of the combustion burner M1 was completed, the measurement of the ejecting amount of the raw material powder of the combustion burners M2 to M7, in place of the combustion burner M1, was performed in order.

In Experimental Example 1, as shown in FIG. 10, the dispersibility of the raw material powder of each of the combustion burners M1 to M7 was evaluated using a raw material powder receptor 81 that is shown in FIG. 9 by disposing any one of the combustion burners from among the combustion burners M1 to M7 above the raw material powder receptor 81.

As shown in FIG. 9, the raw material powder receptor 81 includes areas (12 areas in the case of FIG. 9) that are divided into equal parts in a peripheral manner, and is set to have a configuration that is capable of respectively measuring an amount of the raw material powder that drops onto each area.

In Experimental Example 1, after the use of each of the combustion burners M1 to M7, an ejecting amount of the raw material powder that was ejected onto each area of the raw material powder receptor 81 was measured, and a minimum value of the ejecting amount of the raw material powder and a maximum value of the ejecting amount of the raw material powder were determined when each of the combustion burners M1 to M7 was used.

In addition, a ratio of the minimum value with respect to the maximum value of the ejecting amount of the raw material powder ((minimum value of the ejecting amount of the raw material powder)/(maximum value of the ejecting amount of the raw material powder)) that was ejected from the raw material powder-ejecting port 53 for each of the abovementioned combustion burners M1 to M7 was set as an index of the dispersibility of the raw material powder.

Additionally, the closer the ((minimum value of the ejecting amount of the raw material powder)/(maximum value of the ejecting amount of the raw material powder)) was to 1, the more favorable the dispersibility of the raw material powder.

Figure 11:
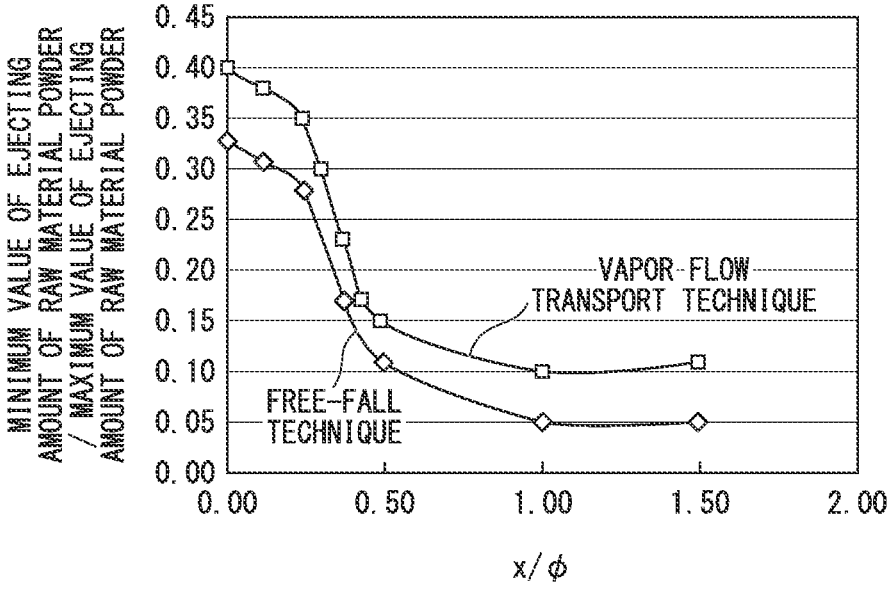
FIG. 11 is a view (a graph) that shows a relationship between (a minimum value of the ejecting amount of the raw material powder)/(a maximum value of the ejecting amount of the raw material powder) and (a distance x)/(the external diameter $\phi$ of the second circular member) when raw material powder is supplied by a free-fall technique and a vapor flow transport technique using a burner apparatus (a burner apparatus that includes any one of combustion burners M1 to M7) of Experimental Example 1.

FIG. 11 is a view (a graph) that shows a relationship between (a minimum value of the ejecting amount of the raw material powder)/(a maximum value of the ejecting amount of the raw material powder) and (a distance x)/(the external diameter ϕ of the second circular member) when raw material powder is supplied by a free-fall technique and a vapor flow transport technique using a burner apparatus (a burner apparatus that includes any one of combustion burners M1 to M7) of Experimental Example 1.

Summary of Results of Experimental Example 1

As can be seen from reference to FIG. 11, the dispersibility of the combustion burners M1 to M3 was practically equivalent. In comparison with the combustion burners M1 to M3, a sudden drop in the dispersibility was seen in the combustion burner M4.

In comparison with the other combustion burners M1 to M4, it was found that the dispersibility of the combustion burners M5 to M7 was extremely low.

In addition, in the combustion burners M6 and M7, a situation in which a striped flow, in which the raw material powder is unevenly distributed, is ejected from the ejecting port was visually confirmed. In the combustion burner M5, a weak striped flow of the raw material powder was confirmed. In the combustion burners M1 to M4, a flow of the raw material powder was not confirmed.

From the abovementioned results, it is possible to confirm that it is important to take the internal diameter d of the raw material powder introduction pipe 27 into account, and to dispose the raw material powder introduction pipe 27 so that a relationship between the internal diameter d of the raw material powder introduction pipe 27 and the external diameter ϕ of the second circular member 32 satisfies Expression (4) below, and so that the extension length of the inner wall surface 27*a* of the raw material powder introduction pipe 27 passes through (refer to FIG. 3) a range of a distance of two times the square root of half of ϕ from the central axis A of the burner main body 21.

$$\theta > 2\sqrt{2} \times d \quad (4)$$

In addition, in the combustion burners M2 to M7, the position of an area that represents a maximum value of the ejecting amount of the raw material powder was fixed. However, in the combustion burner M1, the area that represented the maximum value of the ejecting amount of the raw material powder was uncertain each time the test was performed, and the position of an area that represented the maximum value of the ejecting amount of the raw material powder fluctuated in a substantially symmetrical manner with the central axis A of the burner main body 21 as the center thereof

EXPERIMENTAL EXAMPLE 2

In Experimental Example 2, an experiment was performed using combustion burners N1 to N7 that are mentioned below.

In this instance, the configurations of each of the combustion burners N1 to N7 will be described with reference to FIG. 3 and FIG. 6.

In the combustion burner N1, the central axis A of the burner main body 21 was designed to intersect the axis B1 that extends from the central axis B of the raw material powder introduction pipe 27.

In the combustion burner N2, the distance x between the axis B1 that extends from the central axis B of the raw material powder introduction pipe 27 and the central axis A of the burner main body 21 was designed so that the axis B1 and the central axis A are separated by a distance of one eighth of the external diameter ϕ of the second circular member 32 (refer to FIG. 3).

In the combustion burner N3, the distance x between the axis B1 that extends from the central axis B of the raw material powder introduction pipe 27 and the central axis A of the burner main body 21 was designed so that the axis B1 and the central axis A are separated by a distance of a quarter of the external diameter ϕ of the second circular member 32.

In the combustion burner N4, the distance x between the axis B1 that extends from the central axis B of the raw material powder introduction pipe 27 and the central axis A of the burner main body 21 was designed so that the axis B1 and the central axis A are separated by a distance of three eighths of the external diameter ϕ of the second circular member 32.

In the combustion burner N5, the distance x between the axis B1 that extends from the central axis B of the raw material powder introduction pipe 27 and the central axis A of the burner main body 21 was designed so that the axis B1 and the central axis A are separated by a distance of a half of the external diameter ϕ of the second circular member 32.

In the combustion burner N6, the distance x between the axis B1 that extends from the central axis B of the raw material powder introduction pipe 27 and the central axis A of the burner main body 21 and the external diameter ϕ of the second circular member 32 were set to be equivalent.

In the combustion burner N7, the distance x between the axis B1 that extends from the central axis B of the raw material powder introduction pipe 27 and the central axis A of the burner main body 21 was set to be 1.5 times the external diameter ϕ of the second circular member 32.

In the combustion burners N1 to N7, a number of raw material powder introduction pipes 27 was set to eight, and the eight raw material powder introduction pipes 27 were disposed so as to be rotationally symmetrical to the central axis A of the burner main body 21.

The combustion burners N1 to N7 differed from those of the combustion burners M1 to M7 (combustion burners that include a single raw material powder introduction pipe 27 only) that were described in Experimental Example 1 in that the eight raw material powder introduction pipes 27 were disposed so as to be rotationally symmetrical to the central axis A of the burner main body 21.

In the combustion burners N1 to N7, the same conditions as the combustion burners M1 to M7 were used for the external diameter of the raw material powder introduction pipes 27, and the thickness of the raw material powder introduction pipe 27.

In the combustion burners N1 to N7, the angles θ that are formed by the central axes B of the raw material powder introduction pipes 27 and the external surface 32*a* of the second circular member 32 were set to be 30° in the same manner as the combustion burners M1 to M7.

In the combustion burners M1 to M7 that were used in Experimental Example 1, two raw material powder introduction ports 28 were provided in a single raw material powder introduction pipe 27, but in the combustion burners N1 to N7, only a single raw material powder introduction port 28-1 was provided in a single raw material powder introduction pipe 27.

In addition, in the combustion burners N1 to N7, as the raw material powder-ejecting port 53, an ejecting port that had been opened into a ring shape was used in the same manner as the combustion burners M1 to M7.

The combustion burners N1 to N7 were disposed so that the leading end 21A of the burner main body 21 pointed downward (in other words, so that the central axis A of the burner main body 21 was in a vertical direction).

The experiment was performed using both a free-fall technique and a vapor flow transport technique as the supply method of the raw material powder.

As the raw material powder, glass cullet that was set to a particle diameter of 1 μm to 5 mm ($D_{50}$: 300 μm or less) was used.

Other than the features described above, the combustion burners N1 to N7 used the same configurations as the burner apparatus 10 that is shown in FIG. 6. In other words, in Experimental Example 2, the raw material powder was introduced into the eight raw material powder introduction ports 28-1 after the raw material powder that was supplied from the raw material powder supply source 18 was distributed by the raw material powder distributor 62 that is shown in FIG. 7 and FIG. 8.

The eight raw material powder introduction ports 28-1 and the raw material powder lead-out units 71 to 78 of the raw material powder distributor 62 were connected in an arrangement order in a peripheral direction.

In Experimental Example 2, a maximum value and a minimum value of the ejecting amount that was ejected from each ejecting port of the combustion burners N1 to N7 were measured using the device that was used in Experimental Example 1.

Thereafter, the dispersibility of each of the combustion burners N1 to N7 was evaluated using the ratio of the minimum value with respect to the maximum value of the ejecting amount that was ejected from each ejecting port of the combustion burners N1 to N7.

Figure 12:
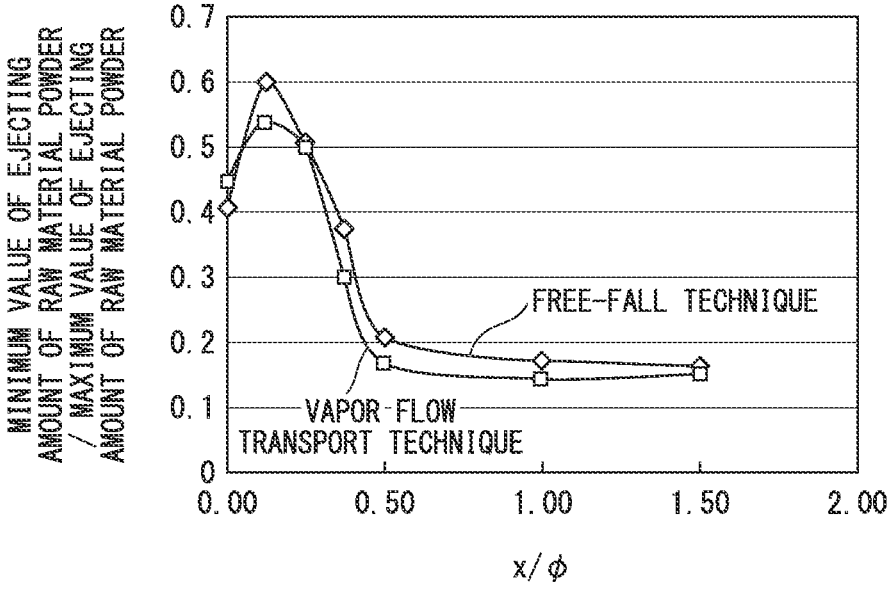
FIG. 12 is a view (a graph) that shows a relationship between (a minimum value of the ejecting amount of the raw material powder)/(a maximum value of the ejecting amount of the raw material powder) and (a distance x)/(the external diameter $\phi$ of the second circular member) when raw material powder is supplied by a free-fall technique and a vapor flow transport technique using a burner apparatus (a burner apparatus that includes any one of combustion burners N1 to N7) of Experimental Example 2.

FIG. 12 is a view (a graph) that shows a relationship between (a minimum value of the ejecting amount of the raw material powder)/(a maximum value of the ejecting amount of the raw material powder) and (a distance x)/(the external diameter ϕ of the second circular member) when raw material powder is supplied by a free-fall technique and a vapor flow transport technique using a burner apparatus (a burner apparatus that includes any one of combustion burners N1 to N7) of Experimental Example 2.

As can be seen from reference to FIG. 12, it was found that dispersibility decreased severely in cases in which the combustion burners N4 to N6, in which a value of x/ϕ was set to three eights or more, were used. In addition, in cases in which the combustion burners N4 to N6 were used, a striped flow was confirmed in the raw material powder that was ejected from the raw material powder-ejecting port 53.

In addition, it was found that, in the combustion burner N1, in which the value of x/ϕ was set to 0, there was a decrease in the dispersibility in comparison with the combustion burners N2 and N3.

It is thought that the reason for this is that a situation in which unevenness of raw material powder overlaps in the raw material powder introduction ports 28-1 that are disposed in adjacent positions is generated since a position at which unevenness of remaining raw material powder flows fluctuates symmetrically with the central axis A of the burner main body 21 as the center thereof.

Figure 13:
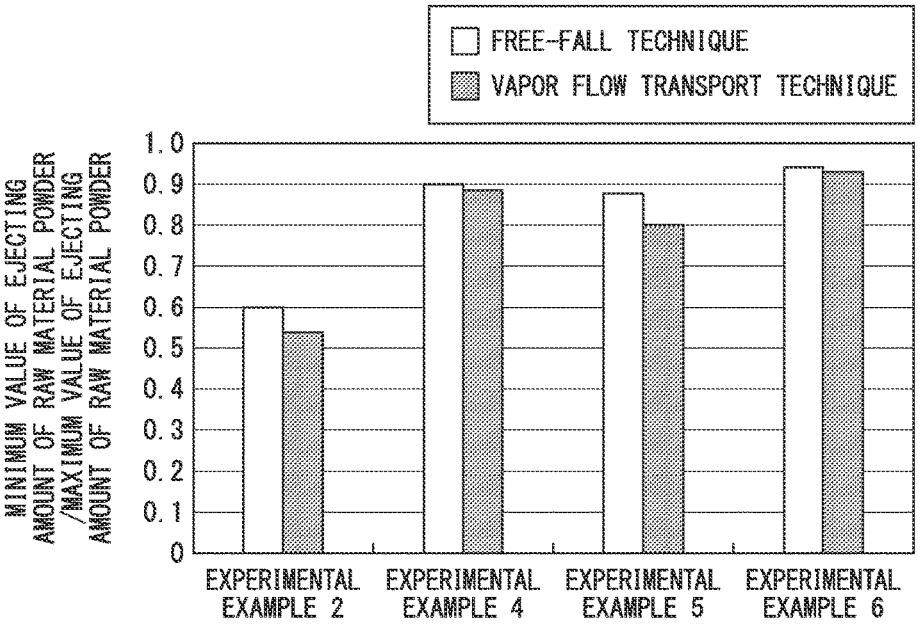
FIG. 13 is a view (a graph) that shows (a minimum value of the ejecting amount of the raw material powder)/(a maximum value of the ejecting amount of the raw material powder) when burner apparatuses of Experimental Examples 2, 4, 5 and 6 are used.

In order to compare the powder dispersibility depending on the setting conditions and differences in the burner apparatus of each experiment, the ratio of the minimum value and the maximum value of the ejecting amount of the raw material powder ((minimum value of the ejecting amount of the raw material powder)/(maximum value of the ejecting amount of the raw material powder)) in each Experimental Example is shown in FIG. 13. As mentioned earlier, the closer this value is to 1, the more favorable the dispersibility.

Additionally, in FIG. 13, the experimental results of a free-fall technique and a vapor flow transport technique are shown side by side. In FIG. 13, a result that is shown for Experimental Example 2 was a result using the combustion burner N2.

EXPERIMENTAL EXAMPLE 3

A combustion experiment was performed, and a raw material powder-heating experiment was performed in the flame region with similar conditions to those of Experimental Example 2 using a burner apparatus (refer to FIG. 6) that included the combustion burner N2, the dispersibility of which was highest in Experimental Example 2. At this time, the raw material powder was supplied with the free-fall technique and the vapor flow transport technique.

As the raw material powder, glass cullet that was set to a particle diameter of 1 μm to 5 mm ($D_{50}$: 300 μm or less) was used.

In addition, oxygen was supplied to the first burnable fluid supply pathway 41 so that an ejecting rate from the leading end 21A of the burner main body 21 was 10 m/second, and city gas was supplied to the fuel fluid supply pathway 42 so that an ejecting rate from the leading end 21A of the burner main body 21 was 10 m/second.

Oxygen was supplied to the raw material powder supply pathway 43 so that an ejecting rate from the leading end 21A of the burner main body 21 was 4 m/second in the flow transport technique, and so that an ejecting rate from the leading end 21A of the burner main body 21 was 1.5 m/second in the free-fall technique.

In addition, city gas was supplied to the second burnable fluid supply pathway 44 so that an ejecting rate from the leading end 21A of the burner main body 21 was 10 m/second.

A heat delivery efficiency η, which shows a ratio of heat delivery energy Q to the raw material powder with respect to a combustion amount I of city gas, was respectively determined for the free-fall technique and the vapor flow transport technique using Expression (5) below.

$$\eta = Q/I \times 100(\%) \quad (5)$$

As a result of this, in Experimental Example 3, the heat delivery efficiency of the free-fall technique was 54%, and the heat delivery efficiency of the vapor flow transport technique was 51%.

In addition, when the combustion experiment was implemented using the combustion burner M1, which had the highest dispersibility in Experimental Example 1, the heat delivery efficiency η was 46% in the free-fall technique, and 42% in the vapor flow transport technique. The heat delivery efficiency η of the combustion burner N2 of Experimental Example 3 was higher than that of the combustion burner M1.

EXPERIMENTAL EXAMPLE 4

Among the eight raw material powder introduction pipes 27, the raw material powder was introduced from four raw material powder introduction pipes 27 that are disposed in a rotationally symmetrical manner with respect to the central axis A of the burner main body 21 using a burner apparatus that included the combustion burner N2, which had the highest dispersibility in Experimental Example 2 (refer to FIG. 6).

In addition, two raw material powder introduction ports (the raw material powder introduction ports 28-1 and 28-2) were provided in a single raw material powder introduction pipe 27.

In the raw material powder distributor 62, two raw material powder lead-out units (two of the raw material powder lead-out units 71 to 78), which were disposed so as to be point-symmetrical to the center E (refer to FIG. 7) of the raw material powder introduction unit 63, were connected to the raw material powder introduction ports 28-1 and 28-2 that were disposed in the same raw material powder introduction pipe 27.

The four raw material powder introduction pipes 27 that were not used were sealed.

In Experimental Example 3, a combustion experiment was performed, and a raw material powder-heating experiment was performed in the flame region with similar conditions to those of Experimental Example 2 using the burner apparatus that was described above. At this time, the raw material powder was supplied with the free-fall technique and the vapor flow transport technique.

As the raw material powder, glass cullet that was set to a particle diameter of 1 μm to 5 mm ($D_{50}$: 300 μm or less) was used.

In addition, oxygen was supplied to the first burnable fluid supply pathway 41 so that an ejecting rate from the leading end 21A of the burner main body 21 was 10 m/second, and city gas was supplied to the fuel fluid supply pathway 42 so that an ejecting rate from the leading end 21A of the burner main body 21 was 10 m/second.

Oxygen was supplied to the raw material powder supply pathway 43 so that an ejecting rate from the leading end 21A of the burner main body 21 was 4 m/second in the flow transport technique, and so that an ejecting rate from the leading end 21A of the burner main body 21 was 1.5 m/second in the free-fall technique.

In addition, oxygen was supplied to the second burnable fluid supply pathway 44 so that an ejecting rate from the leading end 21A of the burner main body 21 was 10 m/second.

A heat delivery efficiency, which shows a ratio of heat delivery energy to the raw material powder with respect to a combustion amount of city gas, was respectively determined for the free-fall technique and the vapor flow transport technique.

As a result of this, in Experimental Example 4, the heat delivery efficiency of the free-fall technique was 65%, and the heat delivery efficiency of the vapor flow transport technique was 62%.

From these results, it was found that even when compared to Experimental Example 3, dispersibility and the heat delivery efficiency were greatly improved in the burner apparatus of Experimental Example 4.

In addition, the dispersibility of the raw material powder using the conditions of Experimental Example 4 was confirmed. The results are shown in FIG. 13.

EXPERIMENTAL EXAMPLE 5

Among the raw material powder lead-out units 71 to 78, opposing raw material powder lead-out units were connected to the raw material powder introduction ports 28-1 and 28-2 so as to be adjacent using a burner apparatus that includes the combustion burner N2 (refer to FIG. 6). This feature differs from Experimental Example 4.

In Experimental Example 5, a similar experiment to that of Experimental Example 4 was performed using the same conditions.

As a result of this, in Experimental Example 5, the heat delivery efficiency of the free-fall technique was 63%, and the heat delivery efficiency of the vapor flow transport technique was 60%.

In addition, the dispersibility of the raw material powder using the conditions of Experimental Example 5 was confirmed. The results are shown in FIG. 13.

As can be seen from reference to FIG. 13, in Experimental Example 5, the dispersibility of the raw material powder improved in comparison with the results of Experimental Example 2, but a significant difference from the results of Experimental Example 4 was not found. In addition, in Experimental Example 5, there was a slight decrease in the heat delivery efficiency in comparison with Experimental Example 4.

In addition, it was found that since the difficulty of the design and creation of the combustion burner, and the complexity of use thereof increase when the number of raw material powder introduction pipes 27 is increased, a combustion burner in which the plurality of raw material powder introduction ports 28-1 and 28-2 are disposed in the raw material powder introduction pipe 27 is more desirable than a combustion burner in which the number of raw material powder introduction pipes 27 is merely increased by the same number.

EXPERIMENTAL EXAMPLE 6

In Experimental Example 6, a combustion burner in which three raw material powder introduction ports (three raw material powder introduction ports that are set to similar configurations to those of the raw material powder introduction ports 28-1 and 28-2) are respectively provided in the four raw material powder introduction pipes 27 of the combustion burner N2 that was used in Experimental Example 4, was used.

At this time, as the raw material powder distributor 62, 12 raw material powder lead-out units (raw material powder lead-out units that are set to similar configurations to those of the raw material powder lead-out units 71 to 78) are used. In addition, raw material powder lead-out units that were disposed four apart from one another in a peripheral direction of the raw material powder distribution unit 64 were connected to three raw material powder introduction ports that were disposed in the same raw material powder introduction pipe 27.

In Experimental Example 6, a similar experiment to that of Experimental Example 4 was performed using the same conditions.

As a result of this, in Experimental Example 6, the heat delivery efficiency of the free-fall technique was 65%, and the heat delivery efficiency of the vapor flow transport technique was 62%.

In addition, the dispersibility of the raw material powder using the conditions of Experimental Example 6 was confirmed. The results are shown in FIG. 13.

As a result, in Experimental Example 6, there was almost no difference in the dispersibility of the raw material powder when compared with that of Experimental Example 4. As a result of this, it was found that a sufficient effect was exhibited with two as the number of raw material powder introduction ports 28.

EXPERIMENTAL EXAMPLE 7

The dispersibility of the raw material powder of the raw material powder distributors 62 that were used in Experimental Examples 2 to 5 was confirmed.

As a result of this, a value of (minimum value of the ejecting amount of the raw material powder)/(maximum value of the ejecting amount of the raw material powder) in the raw material powder distributor 62 that includes the eight raw material powder lead-out units 71 to 78 was 0.6.

In Experimental Examples 2 and 3, it seemed that the low dispersibility of the raw material powder had an effect.

However, when the raw material powder distributor 62 was used with the connection method that was described in Experimental Example 4, it is possible to confirm that a value of (minimum value of the ejecting amount of the raw material powder)/(maximum value of the ejecting amount of the raw material powder) was 0.94, and a difference between the minimum value of the ejecting amount of the raw material powder and the maximum value of the ejecting amount of the raw material powder was considerably reduced.

In addition, a value of (minimum value of the ejecting amount of the raw material powder)/(maximum value of the ejecting amount of the raw material powder) of Experimental Example 5, which used the raw material powder distributor 62 with the same connection method as that of Experimental Example 4, was 0.88 in the free-fall technique, and 0.8 in the vapor flow transport technique, and a value of (minimum value of the ejecting amount of the raw material powder)/(maximum value of the ejecting amount of the raw material powder) of Experimental Example 2 was 0.60 in the free-fall technique, and 0.54 in the vapor flow transport technique.

From these results, by using the same connection method as that of Experimental Example 4, it was confirmed that the dispersibility of the raw material powder was improved in comparison with a case of using the raw material powder distributor 62 with the connection method of Experimental Example 2.

EXPERIMENTAL EXAMPLE 8

The dispersibility of the raw material powder of the raw material powder distributor 62 that used the connection method of Experimental Example 6 (a raw material powder distributor that includes 12 raw material powder lead-out units) was confirmed.

A value of (minimum value of the ejecting amount of the raw material powder)/(maximum value of the ejecting amount of the raw material powder) when the raw material powder that is ejected from the twelve raw material powder lead-out units in the raw material powder distributor 62 of Experimental Example 6 was totaled, was 0.55.

Meanwhile, in the configuration of the raw material powder distributor 62 of Experimental Example 6, when the ejecting amounts of the raw material powder that is ejected from three raw material powder lead-out units that are disposed four apart from one another in a peripheral direction of the raw material powder distribution unit 64 in the manner of Experimental Example 6, were added, a value of (minimum value of the ejecting amount of the raw material powder)/(maximum value of the ejecting amount of the raw material powder) was 0.98.

From the abovementioned results, it was possible to confirm that there was not an improvement in the dispersibility of the raw material powder of the raw material powder distributor 62 that was used in the connection method of Experimental Example 6 in comparison with the dispersibility of the raw material powder distributor 62 that was described in Experimental Example 7.

It is thought that this result was caused by the fact that there was not a large difference in the dispersibility of the raw material powder and the heat delivery efficiency in Experimental Example 4 and Experimental Example 6.

EXPERIMENTAL EXAMPLE 9

In Experimental Example 9, similar experiments to those of Experimental Example 4 were performed using combustion burners P1 to P10, in which an inclination angle of the raw material powder introduction pipe 27 (the angle θ that is shown in FIG. 6) in the combustion burner N2 that was described in Experimental Example 4 was changed, and the combustion burner N2 (the angle θ is 30°).

The angle θ was set to 90° in the combustion burner P1, and the angle θ was set to 80° in the combustion burner P2. The angle θ was set to 70° in the combustion burner P3, and the angle θ was set to 60° in the combustion burner P4.

The angle θ was set to 50° in the combustion burner P5, and the angle θ was set to 40° in the combustion burner P6. The angle θ was set to 20° in the combustion burner P7, and the angle θ was set to 10° in the combustion burner P8. The angle θ was set to 5° in the combustion burner P9.

Furthermore, a combustion burner P10 in which the angle θ was set to 0°, or in other words, in which the raw material powder introduction pipe 27 was installed in a burner upper part parallel to the central axis A of the burner main body 21 was prepared.

The dispersibility of the raw material powder and the heat delivery efficiency were respectively measured for the free-fall technique and the vapor flow transport technique using burner apparatuses that included the abovementioned combustion burners P1 to P10. The result is shown in Table 1.

TABLE 1

| | | Combustion Burner | | | | | | | | | | |
|---|---|---|---|---|---|---|---|---|---|---|---|---|
| | | P1 | P2 | P3 | P4 | P5 | P6 | N2 | P7 | P8 | P9 | P10 |
| Angle (°) | | 90 | 80 | 70 | 60 | 50 | 40 | 30 | 20 | 10 | 5 | 0 |
| Vapor Flow Transport Technique | Dispersibility | 0.9 | 0.9 | 0.89 | 0.86 | 0.89 | 0.89 | 0.88 | 0.88 | 0.85 | 0.79 | 0.77 |
| | Heat Delivery Efficiency (%) | 60 | 61 | 61 | 62 | 62 | 61 | 62 | 62 | 60 | 57 | 55 |
| Free-fall Technique | Dispersibility | Blocked | Blocked | Blocked | 0.91 | 0.9 | 0.9 | 0.9 | 0.88 | 0.86 | 0.8 | 0.75 |
| | Heat Delivery Efficiency (%) | | | | 52 | 60 | 65 | 65 | 65 | 63 | 56 | 55 |

From the abovementioned results, in the vapor flow transport technique, the dispersibility of the raw material powder was equivalent in combustion burners P1 to P8 and the combustion burner N2, and judging from the fact that the heat delivery efficiency was also within a range of 61±1%, a significant difference was not observed. However, in the combustion burners P9 and P10, there was a decrease in both the dispersibility and the heat delivery efficiency. In addition, in the combustion experiment of the combustion burners P9 and 10, four striped powder flows were confirmed from the raw material powder-ejecting port.

However, in the free-fall technique, in the combustion burner P1, a blockage occurred inside the raw material powder introduction pipe 27 immediately after initiation of the experiment, and blockages also occurred in the combustion burners P2 and P3 in cases in which the combustion burner was continuously used for a long period of time, or in which the supply amount was increased.

In the combustion burner P4, temporal density unevenness (hereinafter, referred to as pulsations) was confirmed in the raw material powder that was ejected from the raw material powder-ejecting port 53, and the heat delivery efficiency decreased to 52%. It is though that this may be because the transport of the powder inside the raw material powder introduction pipe repeats temporary blocking.

In the combustion burners P5 to P8, and the combustion burner N2, blockages, pulsations, and significant differences in the dispersibility of the raw material powder were not observed. In addition, with a range of 64±1%, a difference in the heat delivery efficiency was not observed either. However, in the combustion burners P9 and P10, there was a decrease in both the dispersibility and the heat delivery efficiency. In addition, in the combustion experiment of the combustion burners P9 and 10, four striped powder flows were confirmed from the raw material powder-ejecting port.

INDUSTRIAL APPLICABILITY

The present invention can be applied to a combustion burner, a burner apparatus, and a raw material powder-heating method that heat a powder (a raw material powder).

REFERENCE SIGNS LIST

10, 60 burner apparatus
11, 61 combustion burner
12 first burnable fluid supply source
14 fuel fluid supply source
16 second burnable fluid supply source
18 raw material powder supply source
19 carrier gas supply source
21 burner main body
21A leading end
23 fuel fluid introduction port
25 burnable fluid introduction port
27 raw material powder introduction pipe
27*a* inner wall surface
28, 28-1, 28-2 raw material powder introduction port
31 first circular member
32 second circular member
32*a* external surface
32A external wall
33 third circular member
34 fourth circular member
41 first burnable fluid supply pathway
42 fuel fluid supply pathway
43 raw material powder supply pathway
44 second burnable fluid supply pathway
51 first burnable fluid-ejecting port
52 fuel fluid-ejecting port
53 raw material powder-ejecting port
54 second burnable fluid-ejecting port
62 raw material powder distributor
63 raw material powder introduction unit
64 raw material powder distribution unit
64A space
64B bottom plate
71 to 78 raw material powder lead-out units
81 raw material powder receptor
A, B central axis
B1 axis
d internal diameter
E center
x distance
θ angle
ϕ external diameter

The invention claimed is:

1. A raw material powder-heating method that heats raw material powder with a flame that is formed at a leading end of a burner main body that configures a burner apparatus using a burnable fluid and a fuel fluid, the method comprising:

a raw material powder introduction step of introducing the raw material powder into a raw material powder supply pathway, which is formed in a tubular shape, through a raw material powder introduction pipe that is disposed in a direction inclined at an angle of larger than 0° and smaller than 90° with respect to the raw material powder supply pathway, and in a direction that does not intersect a central axis of the burner main body; and a heating step of heating the raw material powder with the flame while ejecting the raw material powder that is supplied by the raw material powder supply pathway from powder-ejecting ports, wherein, in the raw material powder introduction step, the raw material powder is introduced through an even number of the raw material powder introduction ports which are disposed in a single raw material powder introduction pipe.

2. The raw material powder-heating method according to claim 1, further comprising a distribution step of distributing a plurality of the raw material powder using a raw material powder distributor before the raw material powder introduction step, and raw material powder that is distributed by the raw material powder distributor is introduced into the even number of the raw material powder introduction ports in the raw material powder introduction step.

* * * * *